US006296216B1

(12) United States Patent
Law et al.

(10) Patent No.: US 6,296,216 B1
(45) Date of Patent: Oct. 2, 2001

(54) SWIVELING COMPUTER PERIPHERAL SUPPORT ASSEMBLY

(75) Inventors: David John Law, Portola Valley; Craig M. Janik, Los Altos Hills, both of CA (US)

(73) Assignee: Speck Product Design, Palo Alto, CA (US)

( * ) Notice: Subject to any disclaimer, the term of this patent is extended or adjusted under 35 U.S.C. 154(b) by 0 days.

(21) Appl. No.: 09/491,677

(22) Filed: Jan. 26, 2000

Related U.S. Application Data

(60) Provisional application No. 60/117,574, filed on Jan. 27, 1999, and provisional application No. 60/138,165, filed on Jun. 8, 1999.

(51) Int. Cl.[7] ..... A47F 5/00

(52) U.S. Cl. ..... 248/289.11; 248/278.1; 248/918

(58) Field of Search ..... 248/289.11, 918, 248/278.1, 282.1; 108/93, 143; 312/223.3, 196

(56) References Cited

U.S. PATENT DOCUMENTS

| | | | |
|---|---|---|---|
| 138,831 | 5/1873 | Wolf . | |
| 1,096,327 | 5/1914 | Thorniley . | |
| 1,351,490 | 8/1920 | Sanborn . | |
| 1,409,525 | 3/1922 | Cox . | |
| 3,920,276 | 11/1975 | Sparrow . | |
| 4,085,961 | 4/1978 | Brown . | |
| 4,307,672 | 12/1981 | Shikimi . | |
| 4,437,638 | 3/1984 | Scheibenpflug . | |
| 4,500,134 | 2/1985 | Kaneko et al. . | |
| 4,515,086 | 5/1985 | Kwiecinski et al. . | |
| 4,562,987 | 1/1986 | Leeds et al. . | |
| 4,567,835 | 2/1986 | Reese et al. . | |
| 4,571,456 | 2/1986 | Paulsen et al. . | |
| 4,624,510 | 11/1986 | Jedziniak . | |
| 4,706,575 | 11/1987 | Hamlin . | |
| 4,706,919 * | 11/1987 | Soberalski et al. | 248/281.11 |
| 4,708,312 | 11/1987 | Rohr . | |
| 4,742,478 | 5/1988 | Nigro, Jr. et al. . | |
| 4,844,388 * | 7/1989 | Kuba et al. | 248/918 X |
| 4,863,124 | 9/1989 | Ball et al. . | |
| 4,863,140 | 9/1989 | Schriner . | |
| 4,974,808 | 12/1990 | Ball . | |
| 5,122,941 | 6/1992 | Gross et al. . | |
| 5,207,791 | 5/1993 | Scherbarth . | |
| 5,257,767 * | 11/1993 | McConnell | 248/918 X |

(List continued on next page.)

*Primary Examiner*—Ramon O. Ramirez
(74) *Attorney, Agent, or Firm*—Gray Cary Ware & Friedenrich LLP

(57) ABSTRACT

A support assembly including first and second mounting brackets each having a mounting surface for attachment to a bottom surface of a desktop, first and second support arms pivotally attached to the first and second mounting brackets respectively to define first and second pivot axes, and a computer keyboard platform having a top support surface and a bottom surface. The first and second support arms rotate in a single plane about the first and second pivot axes respectively. The first and second support arms are pivotally attached to the bottom surface of the platform to define third and fourth pivot axes respectively. The support arms are rotatable relative to the platform in the single plane about the third and fourth pivot axes respectively. The distance between the first and second pivot axes is greater than the distance between the third and fourth pivot axes so that the platform is translatable between the mounting brackets, in a plane that is located between the first plane and the mounting surfaces of the mounting brackets, from a deployed position in front of the desktop to a retracted position underneath the desktop. The keyboard platform can be a computer tray for supporting a computer keyboard, or it can be the computer keyboard itself. The first and second support arms can each include first and second segments pivotally attached together to define fifth and sixth pivot axes for rotation in the single plane.

30 Claims, 25 Drawing Sheets

U.S. PATENT DOCUMENTS

| | | | | |
|---|---|---|---|---|
| 5,260,884 | | 11/1993 | Stern . | |
| 5,323,291 | | 6/1994 | Boyle et al. . | |
| 5,342,009 | | 8/1994 | Lehner . | |
| 5,377,598 | | 1/1995 | Kirchner et al. . | |
| 5,436,792 | | 7/1995 | Leman et al. . | |
| 5,452,531 | | 9/1995 | Graville et al. . | |
| 5,552,960 | | 9/1996 | Nelson et al. . | |
| 5,633,782 | | 5/1997 | Goodman et al. . | |
| 5,768,101 | | 6/1998 | Cheng . | |
| 5,771,814 | | 6/1998 | Clausen . | |
| 5,818,360 | | 10/1998 | Chu et al. . | |
| 5,832,840 | | 11/1998 | Woof . | |
| 5,836,560 | * | 11/1998 | Kaplan et al. | 248/918 X |
| 5,859,762 | | 1/1999 | Clark et al. . | |
| 6,176,456 | * | 1/2001 | Wisniewski | 248/281.11 |

* cited by examiner

SWIVELING COMPUTER PERIPHERAL SUPPORT ASSEMBLY

This application claims the benefit of U.S. Provisional Application No. 60/117,574, filed Jan. 27, 1999, and entitled Swiveling Keyboard, Computer Peripheral Support, and of U.S. Provisional Application No. 60/138,165, filed Jun. 8, 1999, and entitled Swiveling Keyboard Computer Peripheral Support.

FIELD OF THE INVENTION

The present invention relates to computers, and more specifically to a keyboard support tray that stows the keyboard underneath a desktop when not in use.

BACKGROUND OF THE INVENTION

Personal computers are becoming more and more common in many industries and office environments. Personal computer systems comprise among other things a CPU unit, a monitor, a keyboard and a mouse. In order to preserve desktop space, the CPU is often times stowed at the far edge of desktop area furthest away from the user, or on the floor underneath the desk. The monitor is placed on the desktop or mounted on a platform directly over the desktop so the user can easily and ergonomically view it. While the keyboard can also be moved from the desktop to save space, the keyboard must still be supported generally in front of the user and approximately at desktop height when in use. The most common keyboard support is a drawer or tray mounted directly underneath the desktop. The user can pull out the drawer/tray when using the computer, and slide it away under the desktop when the computer is not in use.

It is difficult to make an inexpensive tray with a desirable sliding action and stable support rigidity. Inexpensive trays tend to move and flex while the keyboard is in use, and do not have a smooth, quiet, non sticking movement easily manipulated by a single hand as they are slid underneath the desktop. Trays that slide directly out toward the user provide only one location in its extended position for the keyboard, without any capability to adjust the keyboard location side to side and/or to adjust the angle of the keyboard relative to the front edge of the desktop. Trays must use supports attached to the desktop that are either wider than the length of the tray support, or deeper than the depth of the tray in its retracted position, which is problematic when there is limited space underneath the desktop.

Recently, more complex keyboard support systems have been developed which allow the user to position the keyboard at multiple locations and heights during use, and to slide and/or vertically pivot the keyboard under the desktop when not in use. These keyboard support systems tend to be excessively complex and expensive, thus requiring balancing springs, reinforced tray slides and other movable parts. They often require heavy support structures that are heavy, difficult to operate and necessitate regular lubrication. The excessive size and space used under the desktop for these complex keyboard support systems make them impractical for desktops with limited space underneath. Such systems are not practical to attach to the keyboard itself, and therefore always require a keyboard support platform.

There is a need for an inexpensive retractable keyboard support assembly that provides a stiff support surface when in its extended position, a smooth and simple movement to a retracted position under the desktop, and lateral and angular position adjustments of the keyboard during use. The keyboard support assembly needs to have a simple design with minimal parts for low manufacturing costs, and use minimal space underneath the desktop.

SUMMARY OF THE INVENTION

The present invention solves the aforementioned problems by providing a support assembly for a keyboard tray or keyboard itself that efficiently and smoothly stores the computer keyboard under the desktop. The support assembly has a simple, low cost design, and occupies minimal space underneath the desktop.

The support assembly of the present invention includes first and second mounting brackets each having a mounting surface for attachment to a bottom surface of a desktop, first and second support arms pivotally attached to the first and second mounting brackets respectively to define first and second pivot axes, and a platform having a top support surface and a bottom surface. The first and second support arms rotate in a single plane about the first and second pivot axes respectively. The first and second support arms are pivotally attached to the bottom surface of the platform to define third and fourth pivot axes respectively. The support arms are rotatable relative to the platform in the single plane about the third and fourth pivot axes respectively. The distance between the first and second pivot axes is greater than the distance between the third and fourth pivot axes so that the platform is translatable between the mounting brackets, in a plane that is located between the first plane and the mounting surfaces of the mounting brackets, from a deployed position in front of the desktop to a retracted position underneath the desktop.

In another aspect of the present invention, the support assembly includes first and second mounting brackets each having a mounting surface for attachment to a bottom surface of a desktop, first and second support arms pivotally attached to the first and second mounting brackets respectively to define first and second pivot axes, and a computer keyboard have a top surface with input keys and a bottom surface. The first and second support arms rotate in a single plane about the first and second pivot axes respectively. The first and second support arms are pivotally attached to the bottom surface of the keyboard to define third and fourth pivot axes respectively. The support arms are rotatable relative to the keyboard in the single plane about the third and fourth pivot axes respectively. The distance between the first and second pivot axes is greater than the distance between the third and fourth pivot axes so that the keyboard is translatable between the mounting brackets, in a plane that is located between the first plane and the mounting surfaces of the mounting brackets, from a deployed position in front of the desktop to a retracted position underneath the desktop.

Other objects and features of the present invention will become apparent by a review of the specification, claims and appended figures.

DETAILED DESCRIPTION OF THE PREFERRED EMBODIMENTS

The present invention is retractable keyboard support assembly that provides a rigid support platform for the computer keyboard with minimal parts and expense, and which is easily stowed under the desktop.

Figure 1A:
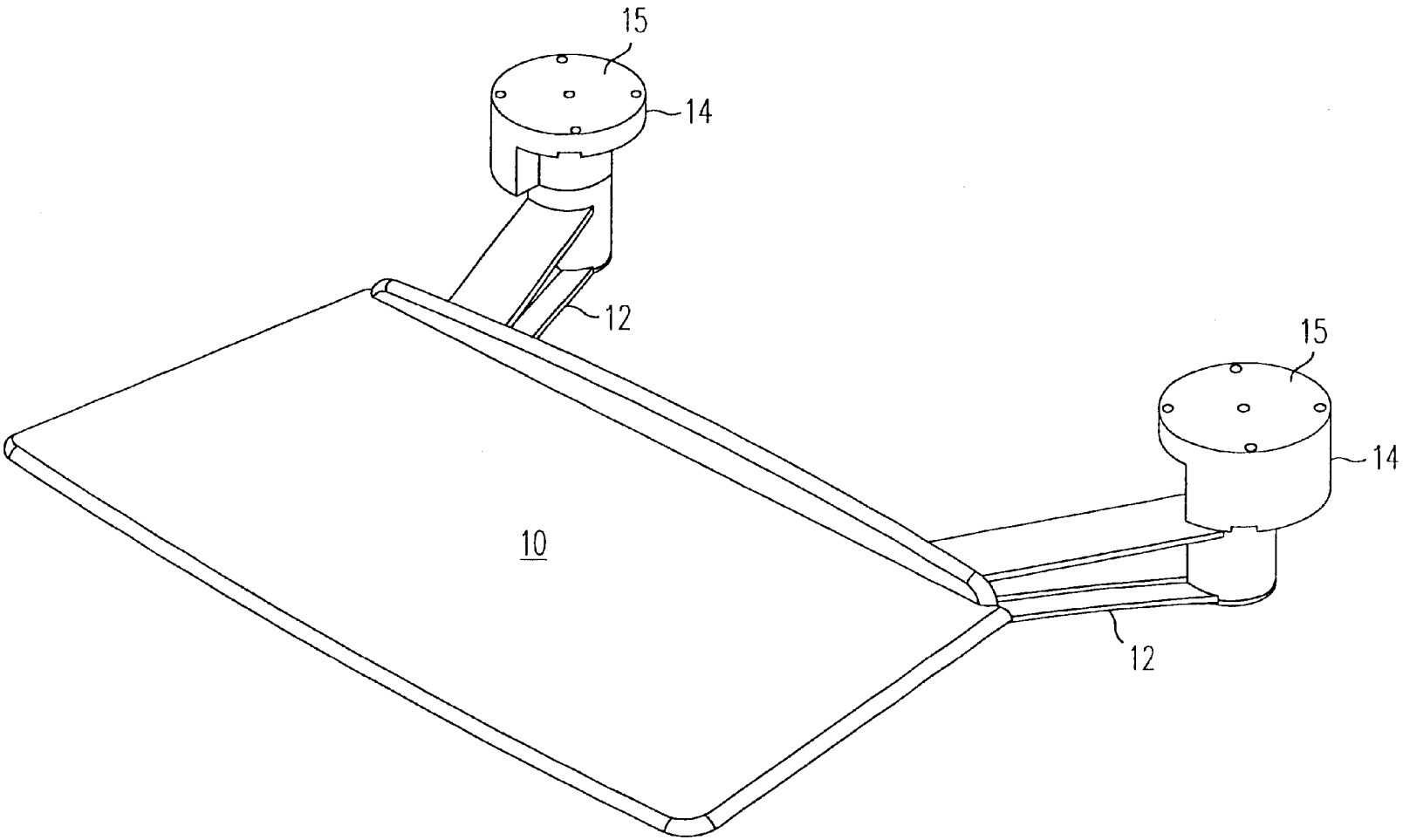
FIG. 1A is an elevated perspective view of the support assembly of the present invention.
Figure 1B:
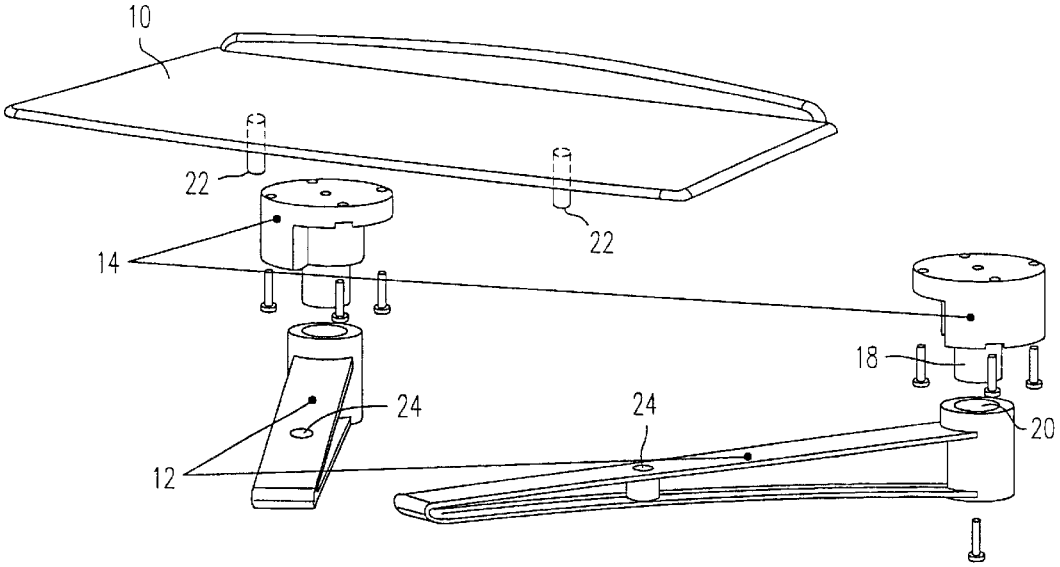
FIG. 1B is a side exploded view of the support assembly of the present invention.
Figure 1C:
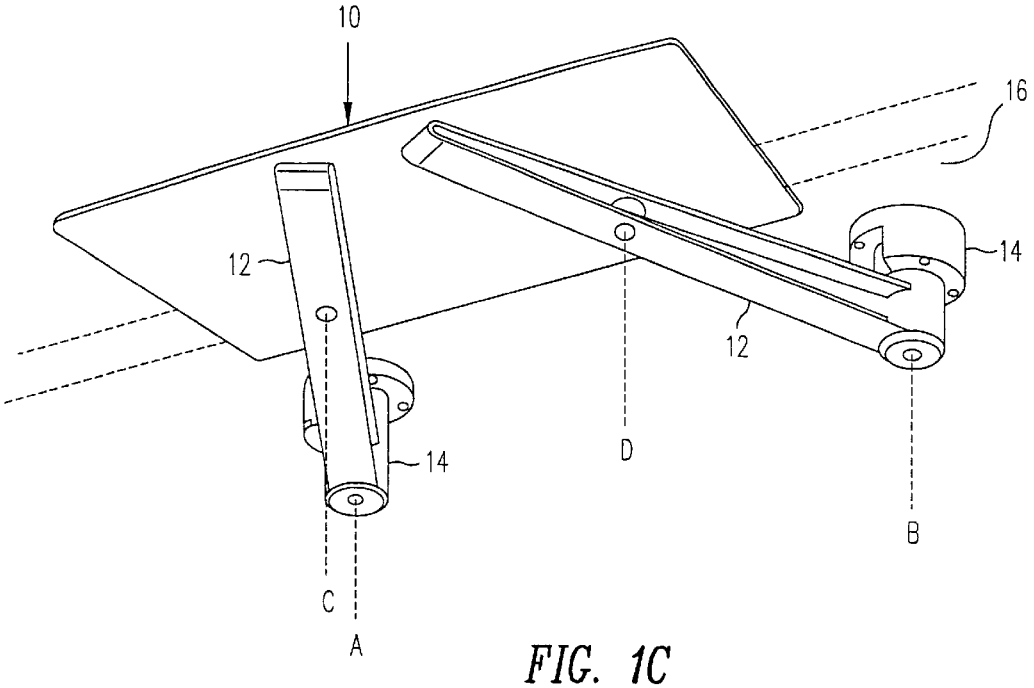
FIG. 1C is a bottom perspective view of the support assembly of the present invention.

The retractable keyboard support assembly of the present invention is illustrated in FIGS. 1A, 1B and 1C, and includes a keyboard support tray (platform) 10 for supporting a computer keyboard, a pair of support arms 12, and a pair of mounting brackets 14.

Figure 1D:
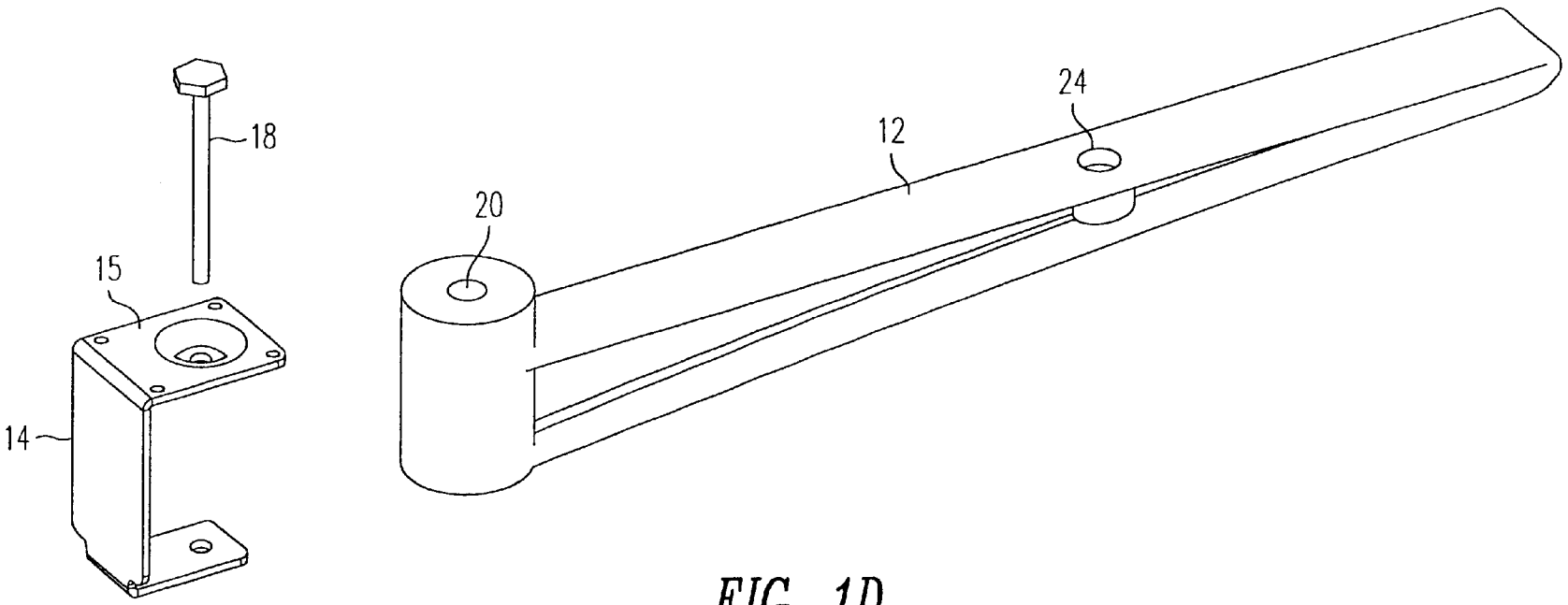
FIG. 1D is a perspective view of an alternate embodiment of the mounting bracket of the present invention.

The mounting brackets 14 include mounting surfaces 15 that are secured to the underside of the desk or workstation 16, preferably with screws or bolts. The proximal end of each support arm 12 is pivotally attached to one of the mounting brackets 14, thus defining first and second pivot axes A and B. These pivot attachments are preferably formed by bolts 18 that rotatably engage with bolt holes 20 formed at the proximal ends of the support arms 12. The bolt holes 20 are fixed to the bolts 18 so that the support arms 12 do not slide off of mounting brackets 14. FIG. 1D illustrates a more simplified mounting bracket 14 that rotatably engages bolt hole 20 while preventing support arm 12 from sliding off bolt 18.

Each support arm 12 is also pivotally attached to the keyboard tray 10, thus defining third and fourth pivot axes C and D. The pivot connections at C and D are preferably formed by bolts 22 extending down from the keyboard tray 10 to rotatably engage with bolt holes 24 formed in the support arms 12. The bolts 22 are fixed into bolt holes 24, or are removably engagable with bolt holes 24 so that the keyboard tray 10 can be conveniently lifted off of the support arms 12 and placed on the user's lap. In the preferred embodiment, each support arm 12 has an I-beam construction, which provides an upper flat support surface with superior rigidity. The support arms 12 preferably extend beyond pivot axes C and D to provide support underneath tray 10 closer to its front edge than pivot axes C and D.

Figure 1E:
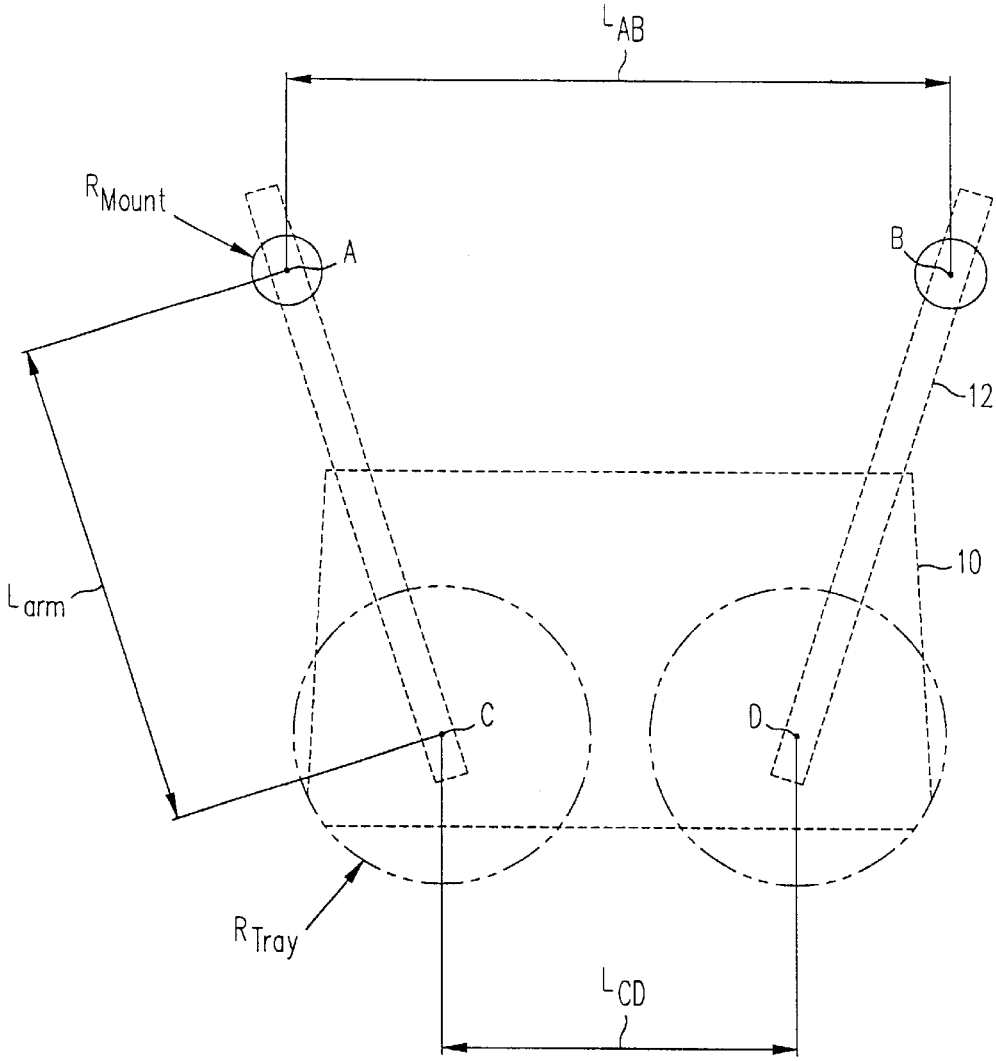
FIG. 1E is a diagram of the support assembly of the present invention, illustrating the various distances between the elements.

The distances between the pivot axes and the dimensions of the tray are important to maximize the tray length and minimize the distance between the mounting brackets, so that the tray can fit in-between the mounting brackets as it is stowed underneath the desktop as described below with regard to FIGS. 2A to 2J. FIG. 1E illustrates the dimensions of the present invention, where the pivot axes A and B are separated by a distance $L_{AB}$, pivot axes C and D are separated by a distance $L_{CD}$, and pivot axes A and C, and B and D, are respectively separated along support arms 12 by a distance $L_{arm}$. The tray 10 has a clearance radius $R_{tray}$, which is the maximum distance that the front or side edges of tray 10 extend from pivot axes C/D. Mounting brackets 14 have a clearance radius $R_{mount}$, which is the maximum distance that each mounting bracket extends from pivot axes A or B toward the other mounting bracket 14 (in the plane that the tray 10 translates). $R_{mount}$ represents the minimal clearance distance that tray 10 can approach axes A or B during its horizontal translation without being physically obstructed by mounting brackets 14. In the preferred embodiment, in order for the tray to properly translate with the desired rotation:

$$L_{CD}<L_{AB}, \tag{1}$$

and $$L_{CD}>(2\cdot L_{arm})-L_{AB} \tag{2}$$

As long as $R_{tray}<L_{arm}$, then $$R_{tray}=L_{AB}-L_{arm}-R_{mount} \tag{3}$$

It should be noted that as $L_{arm}$ approaches $0.5\cdot L_{AB}$, the useable area of the tray is maximized. If the above equations are satisfied, then the tray will horizontally translate between the mounting brackets 14 as explained below, even if the length of the tray exceeds the distance between the mounting brackets 14.

Figures 2A, 2B, 2C:
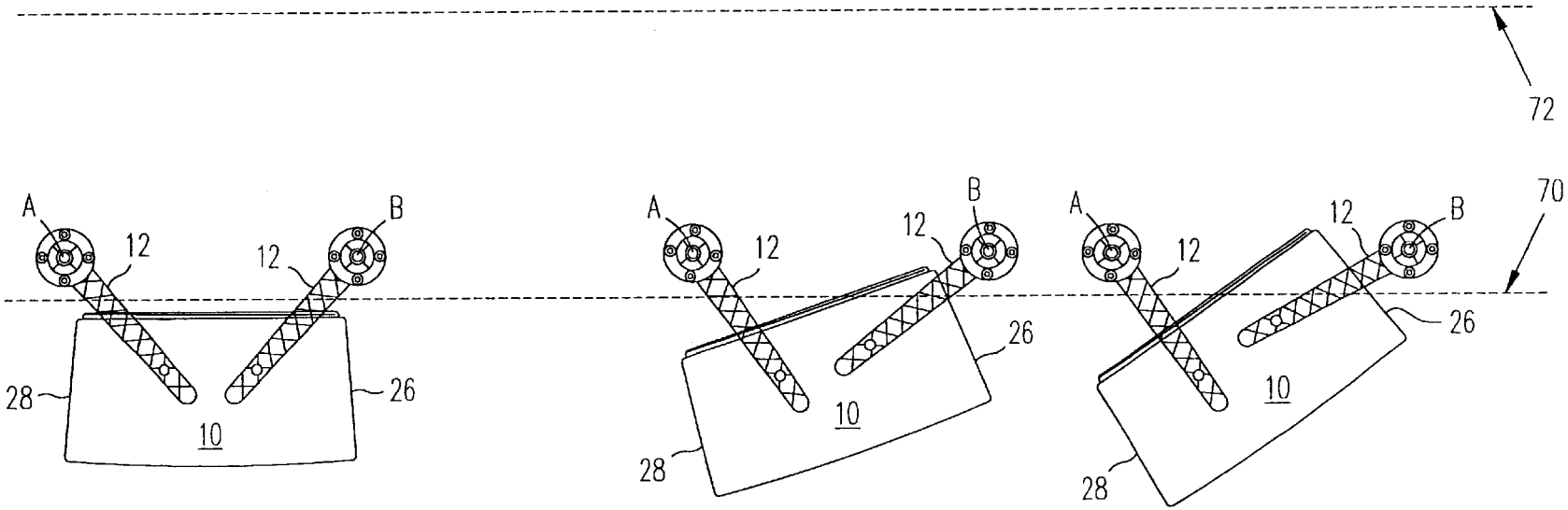
FIGS. 2A to 2J are bottom views of the support assembly of the present invention illustrating the 'S' shaped movement from itS protracted position to its retracted position.
Figures 2D, 2E, 2F, 2G:
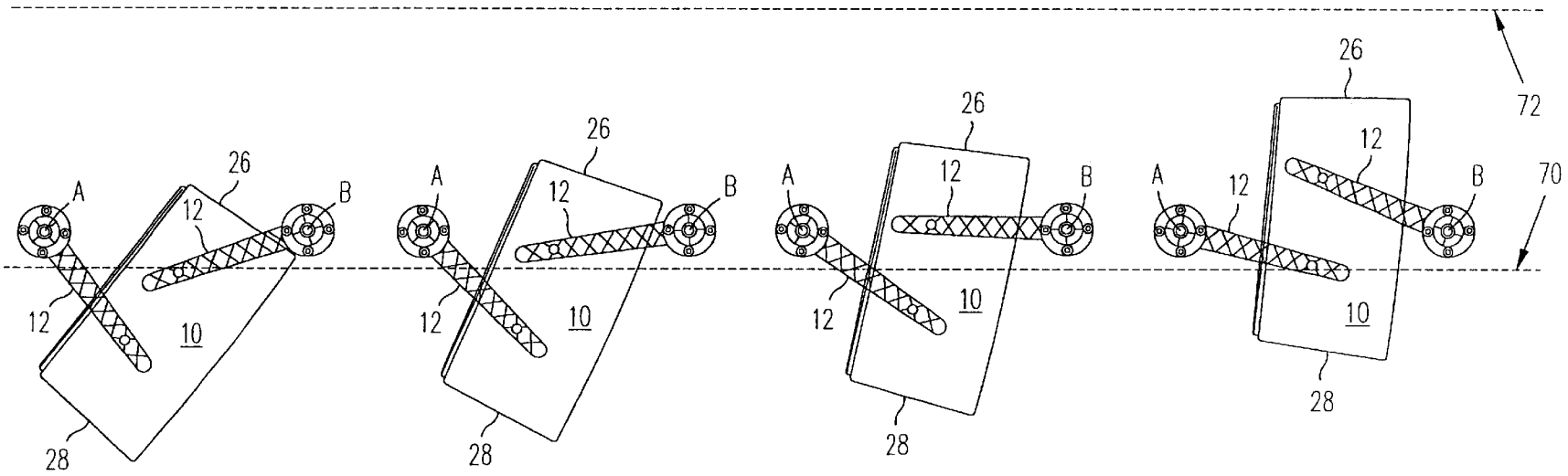
Figures 2H, 2I, 2J:
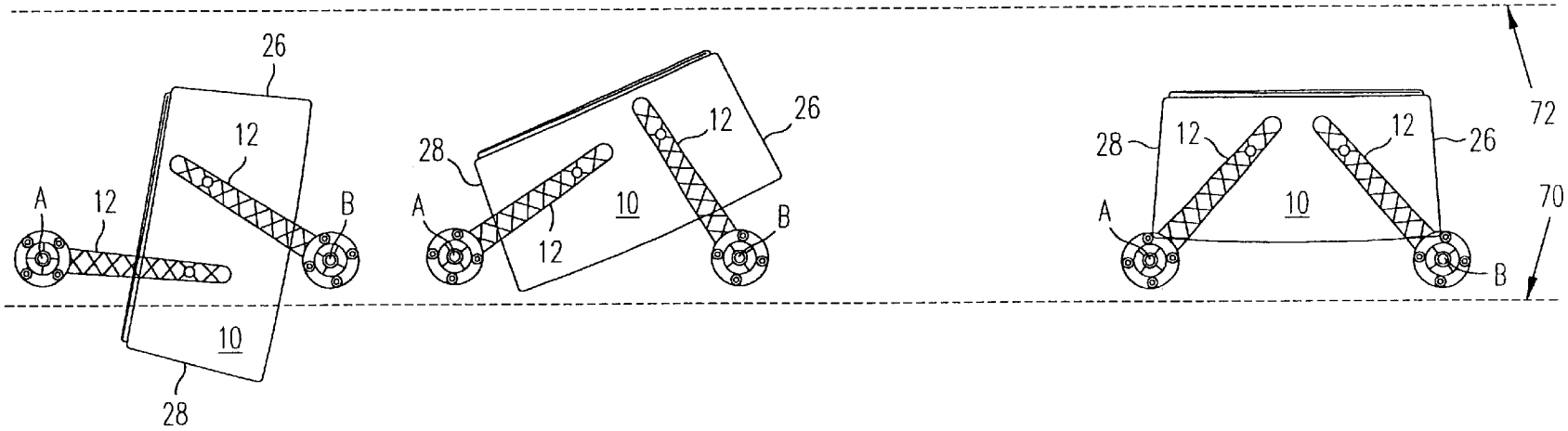

FIGS. 2A to 2J illustrate how the keyboard tray translates horizontally, from a working protracted position in front of the desk's front edge 70 (FIG. 2A), to the stowed retracted position underneath the desk closer to the desk's rear edge 72 (FIG. 2J). The user starts by pushing one end of the tray back (for example the right hand side 26), whereby the tray pivots in a counterclockwise direction so that the tray's right hand side 26 pivots back away from the user (FIGS. 2B and 2C), passes by pivot axis B (FIGS. 2D and 2E) and continues toward the desk's back edge 72 until the tray 10 is rotated approximately 90–110 degrees (FIGS. 2F and 2G). Then, as the user continues to push on tray 10, the tray 10 starts rotating in a clockwise direction whereby the left hand side 28 of the tray 10 pivots away from the user (FIG. 2H), passes by pivot axis A (FIG. 2I) and continues toward rear edge 72 until the tray 10 is rotated back 90–110 degrees and into its retracted position (FIG. 2J). The tray 10 ends up in its original orientation, but it is stored underneath the desk 16. The tray 10 remains at the same height relative to the desk as it snakes in between the two mounting brackets in an "S" type movement, whereby the longer dimension of the tray faces forward at the start and finish of the movement, but faces to the side as it passes between the mounting brackets. The narrower dimension of the tray is rotated to pass between the mounting brackets so that the tray (and keyboard thereon) can be longer than the distance between the mounting brackets.

The above procedure can instead be performed by first pushing back the tray's left hand side 28, in which case the tray pivots clockwise first, then counterclockwise. The user moves tray 10 back from its retracted position to its protracted position by pulling on one end of the tray to reverse the motion depicted in FIGS. 2A to 2J.

The present invention is advantageous over other prior art tray supports because it provides two separate supports to make the assembly stiffer, yet the tray can be easily stowed and deployed with one hand. The movement of the tray takes up less horizontal space compared to using a single pivot point. The keyboard tray 10, and/or the computer keyboard disposed thereon, can be wider than the distance between the mounting brackets attached to the desktop because of the "S" shaped movement of the tray. The support assembly only has five basic parts (tray 10, two arms 12, and two desk mounts 14). No drawer slides are included that need periodic greasing or are prone to racking. It also provides the ability to conveniently angle the keyboard relative to the front edge of the desk top (i.e. the user can leave the tray in the position shown in FIG. 2B). The support arms 12 are light and easy to install separately. The tray 10 has a virtual pivot point which is close to the point at which the user is sitting. Bolt holes 24 could be elongated or slot shaped to add additional movement of tray 10 toward the user.

Figure 3A:
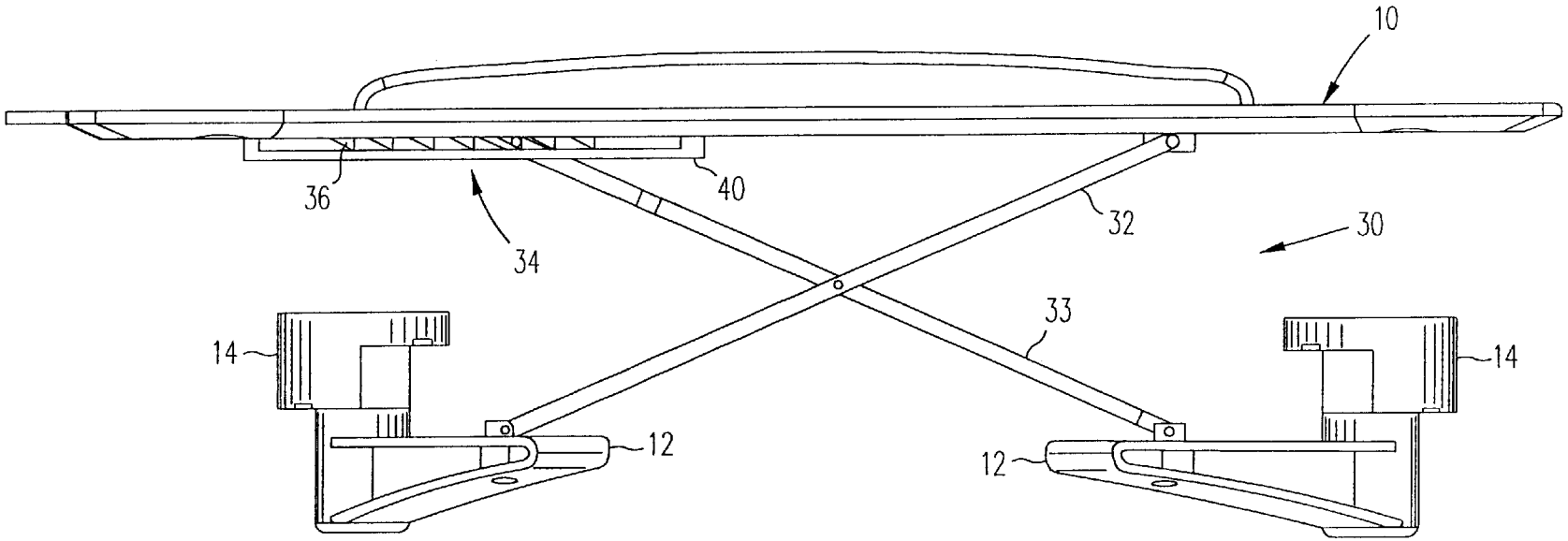
FIG. 3A is a side view of an alternate embodiment of the present invention.
Figure 3B:
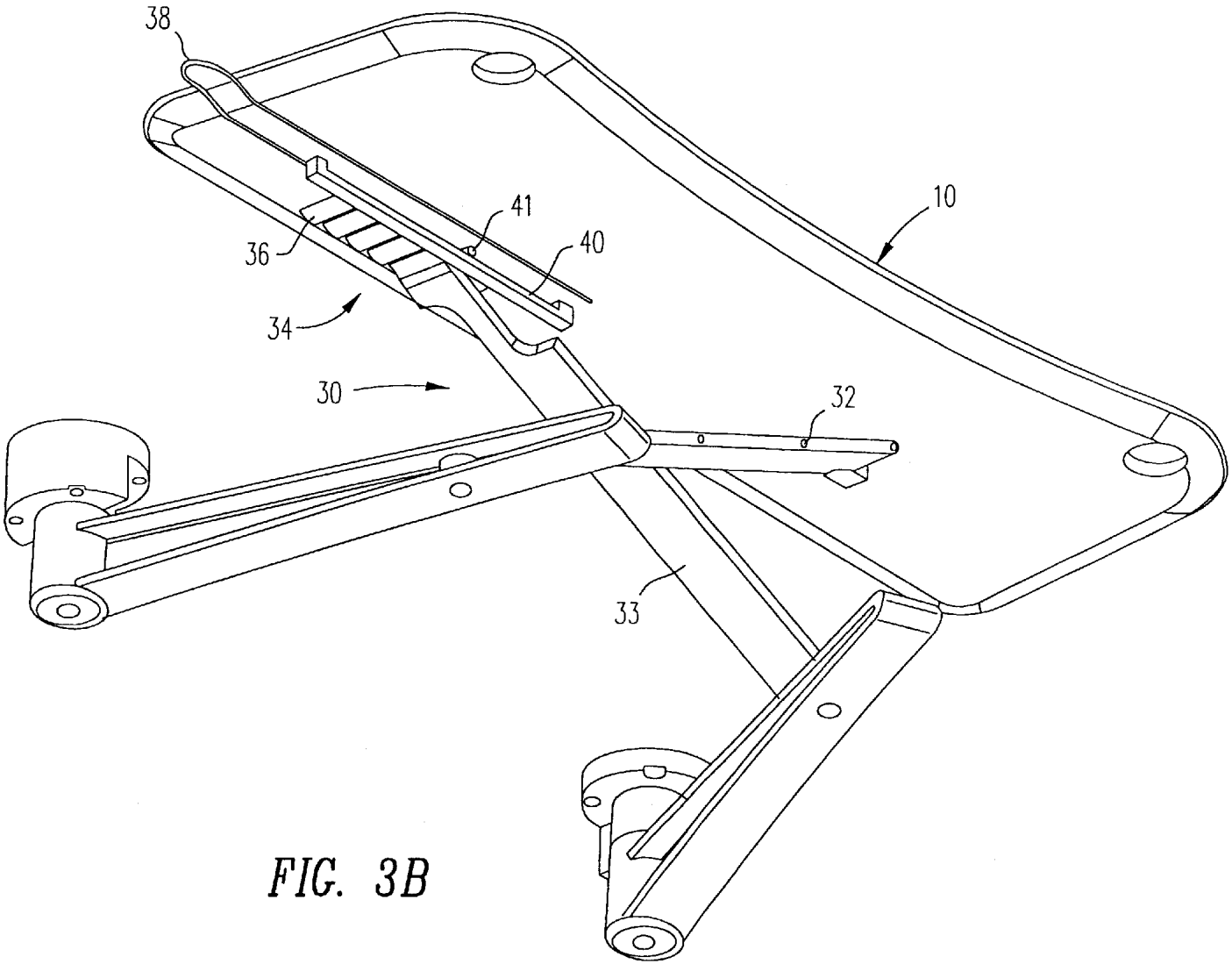
FIG. 3B is a bottom perspective view of the alternate embodiment of the present invention.

FIGS. 3A and 3B illustrate an alternate embodiment of the present invention, which includes a height adjustment mechanism 30 to allow the user to position the tray 10 at various heights relative to the desk 16. The height adjustment mechanism 30 includes a pair of scissor members 32/33 that are pivotally connected together at their midpoints. Each scissor member 32/33 has a first end pivotally connected to one of the support arms 12, where the scissor members 32/33 can pivot relative to the support arms 12 both horizontally and vertically. The second end of scissor member 32 is pivotally mounted to tray 10. The second end of scissor member 33 engages a sliding connector 34 attached and/or formed on the bottom surface of the tray 10. The sliding connector 34 includes a plurality of teeth 36, a flexure member 38, and a retaining member 40 attached to the flexure member 38. The retaining member 40 engages with a pin 41 extending from the second end of scissor member 33 to force it into engagement with teeth 36. The flexure member 38 extends beyond the side of tray 10. The retaining member 40 releases the second end of scissor member 33 from teeth 36 when the flexure member 38 is flexed downwardly by the user. While the second end of scissor member 33 is shown engaging sliding connector 34, other types of fixing devices can be used to fix scissor members 32/33 in place, including a rotatable cam, a screw thread, etc.

To raise the height of the tray 10, the user simply pulls up on tray 10, whereby the scissor members 32/33 pivot about each other. As the tray 10 rises, the ends of support arms 12 move closer together (thus negating the need for any elongated slots), and the second end of scissor member 33 ratchets over teeth 36. Once the desired tray height is achieved and the user releases tray 10, teeth 36 prevent scissor member 33 from moving back in the reverse direction, thus locking the tray at the desired height. To lower tray 10, the user simply presses down on flexure member 38, which pushes scissor member 33 away from teeth 36 and allows the scissor members 32/33 to pivot back down again. Because the teeth 36 and flexure member 38 act as a one way ratchet, the user can raise the height of the keyboard from any level simply by lifting up on the tray 10.

Figure 4A:
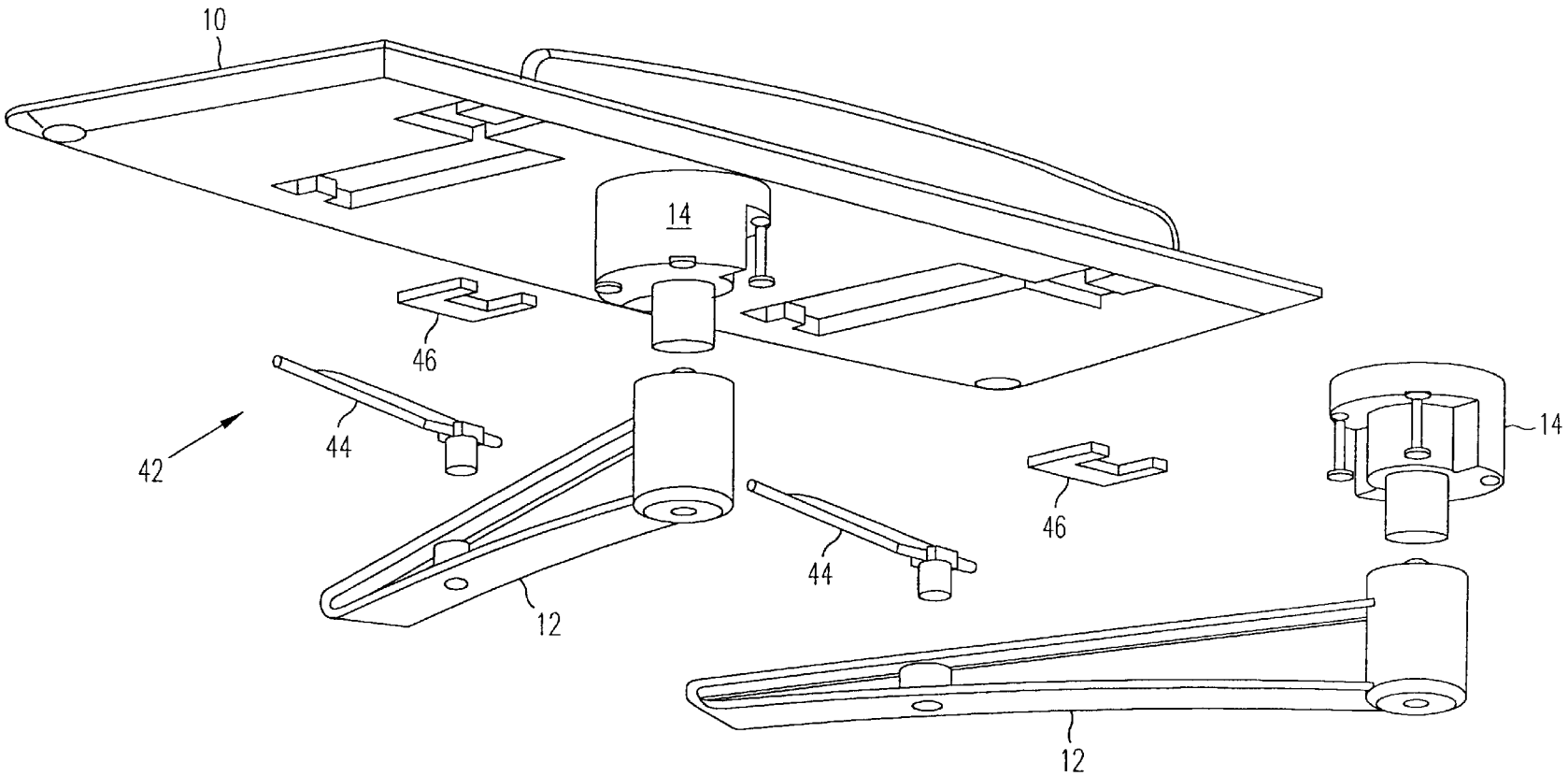
FIG. 4A is a bottom perspective exploded view of a second alternate embodiment of the present invention.
Figure 4B:
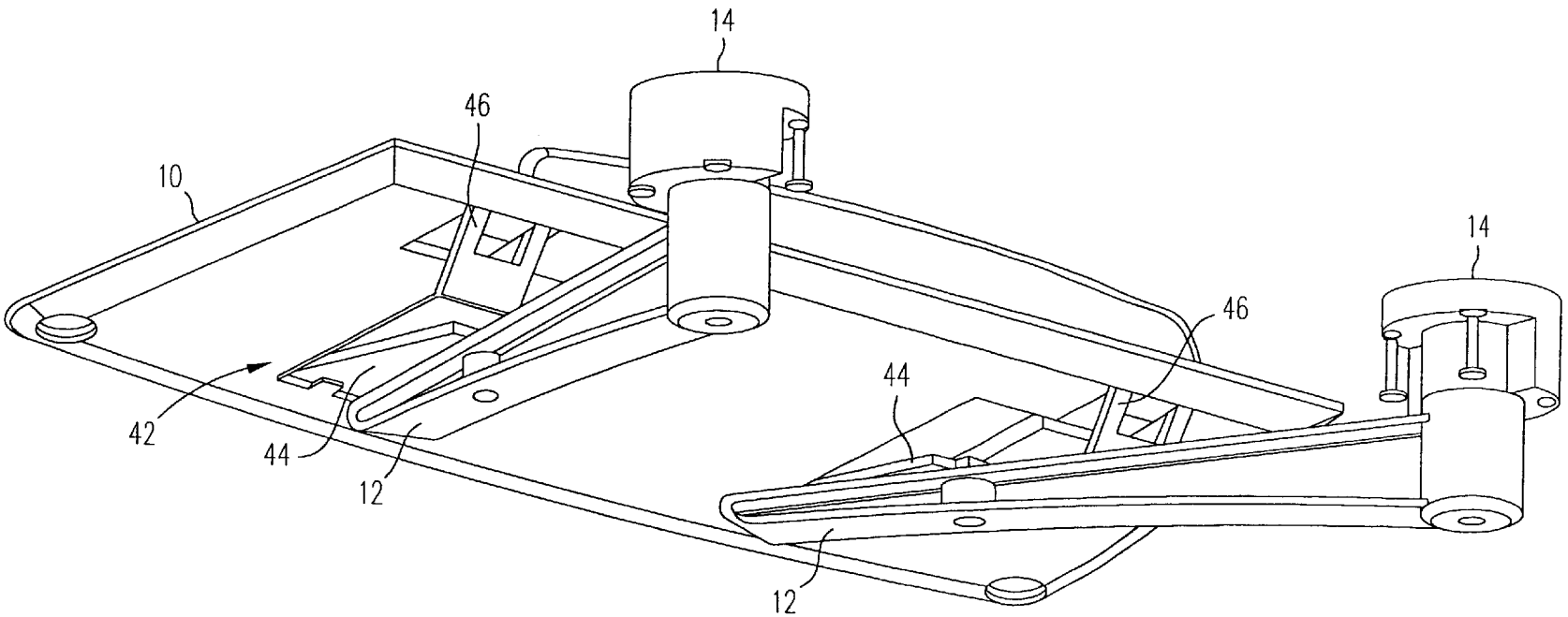
FIG. 4B is a bottom perspective view of the second alternate embodiment of the present invention.
Figure 4C:
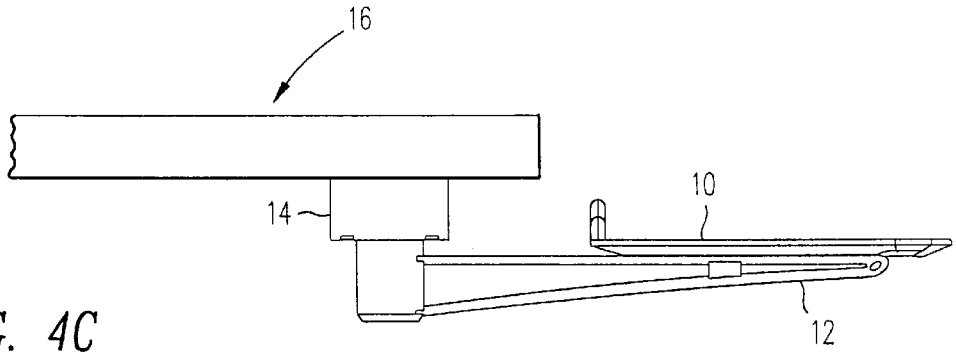
FIGS. 4C to 4F are side views of the second alternate embodiment of the present invention, illustrated the various tilts and raised position of the keyboard support tray.
Figure 4D:
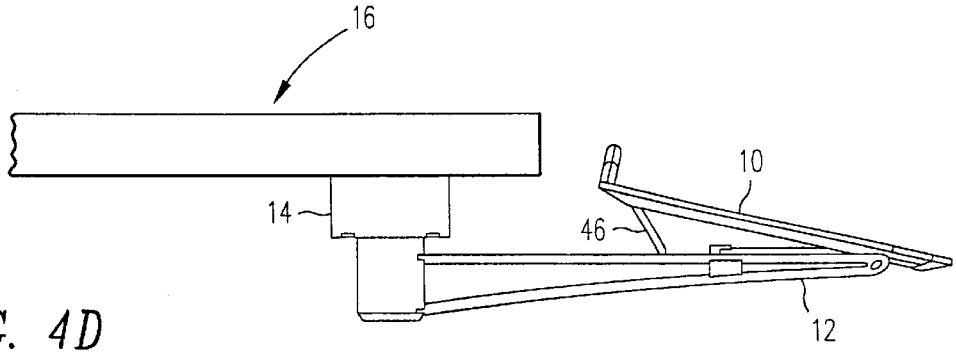
Figure 4E:
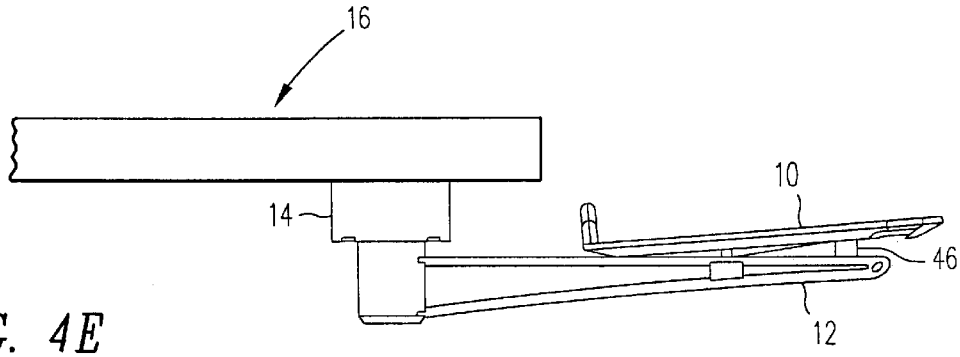
Figure 4F:
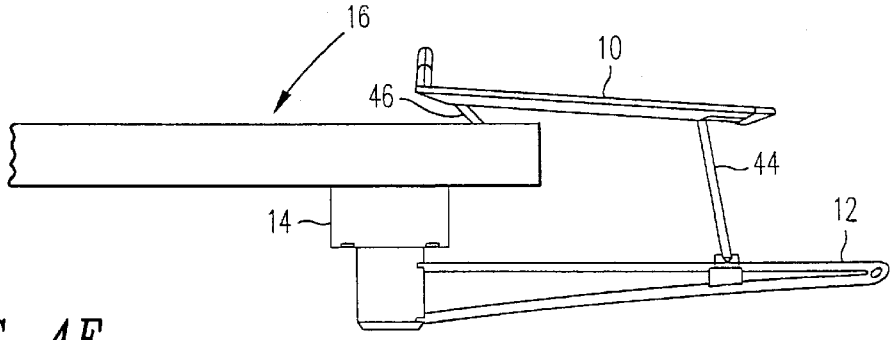

FIGS. 4A and 4F illustrate a second alternate embodiment of the present invention, which includes a height/tilt adjustment mechanism 42 that allows the user to adjust the tilt and the height of tray 10. The height/tilt adjustment mechanism 42 includes pivot lift arms 44 each having one end pivotally attached to tray 10 for vertical pivoting, and the other end pivotally attached to one of the support arms 12 for both vertical and horizontal pivoting. Tilt feet 46 are pivotally attached to the bottom surface of the tray 10 or the top surface of the support arms 12. The pivot lift arms 44 allow the user to raise just the front or back edges of the tray from its un-raised position (FIG. 4C), where tilt feet 46 are pivoted out to maintain a forward tilt (FIG. 4D) or a backward tilt (FIG. 4E) of tray 10. Alternately, the tray 10 can be lifted up to partially rest on the desktop, as illustrated in FIG. 4F. The maximum pivot range of lift arms 44 is limited to a predetermined value to stabilize the tray position on the desktop. The tilt feet 46 can be deployed to adjust the tilt of the tray as it rests on the desktop.

Figure 5A:
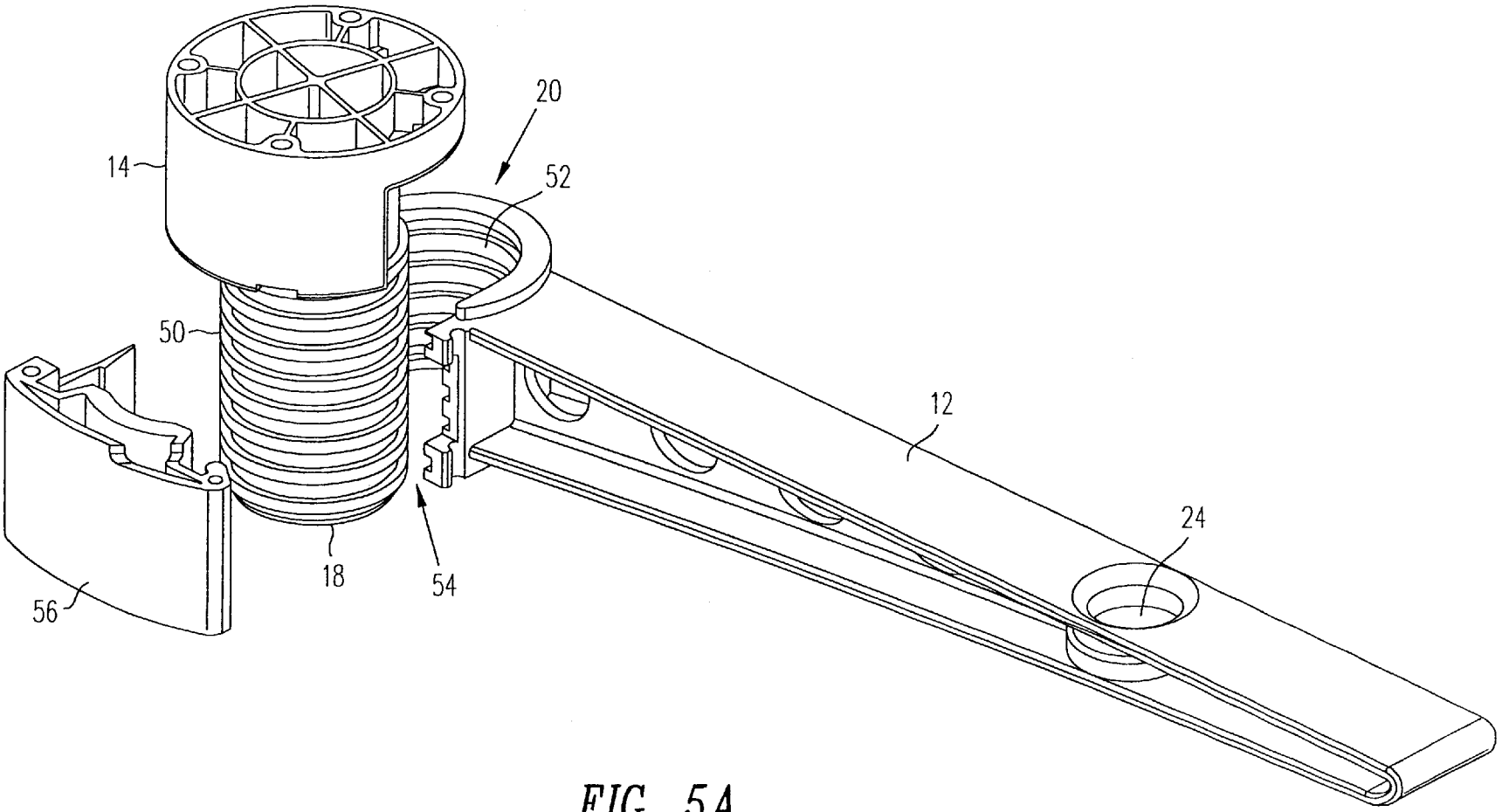
FIG. 5A is a perspective exploded view of a third alternate embodiment of the present invention.
Figure 5B:
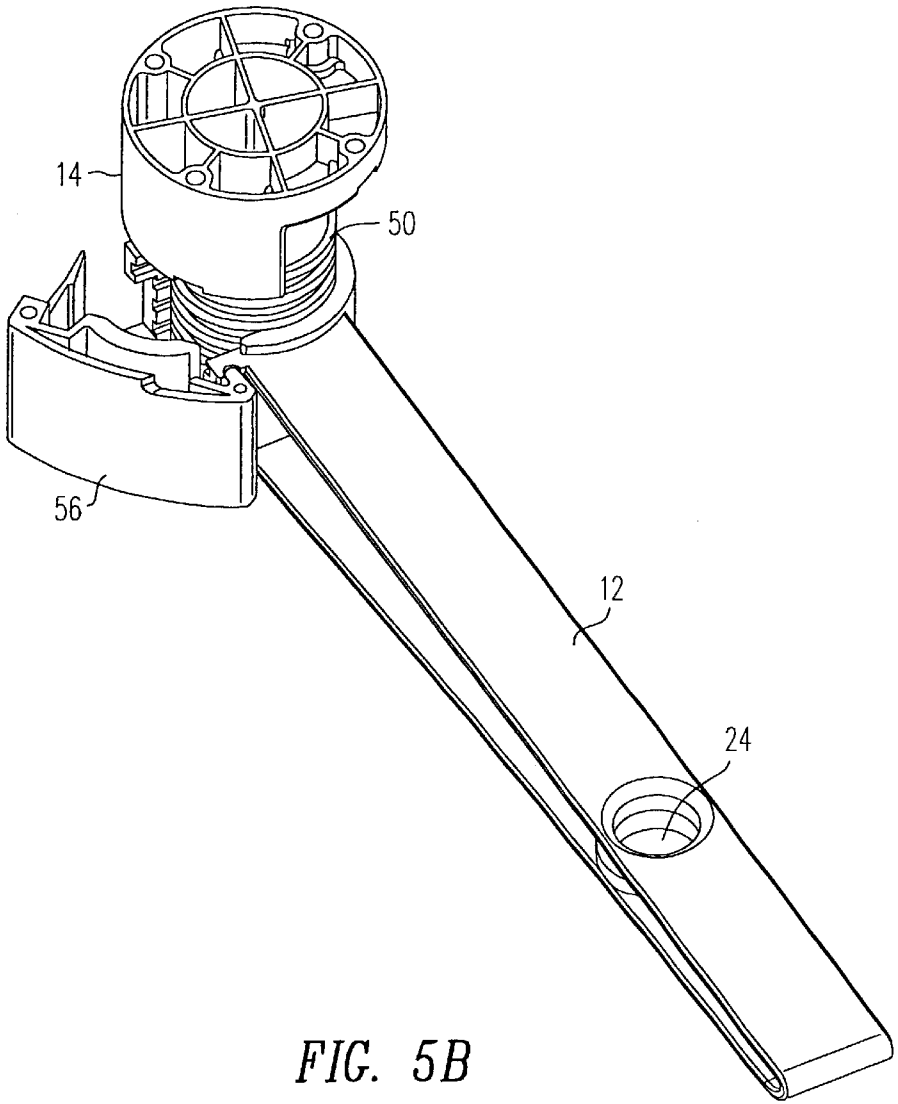
FIG. 5B is a perspective partially exploded view of the third alternate embodiment of the present invention.
Figure 5C:
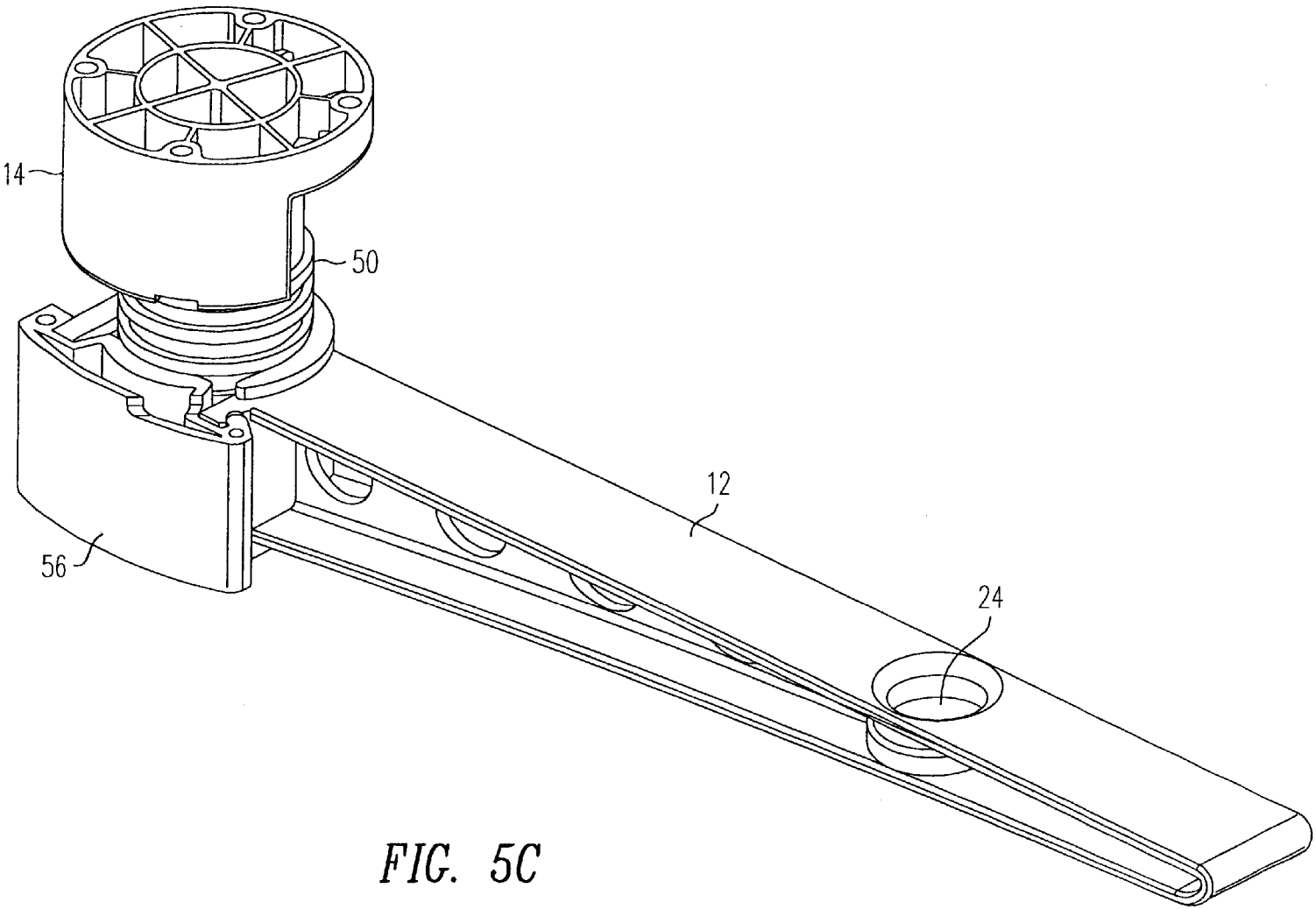
FIG. 5C is a perspective view of the third alternate embodiment of the present invention.
Figure 5D:
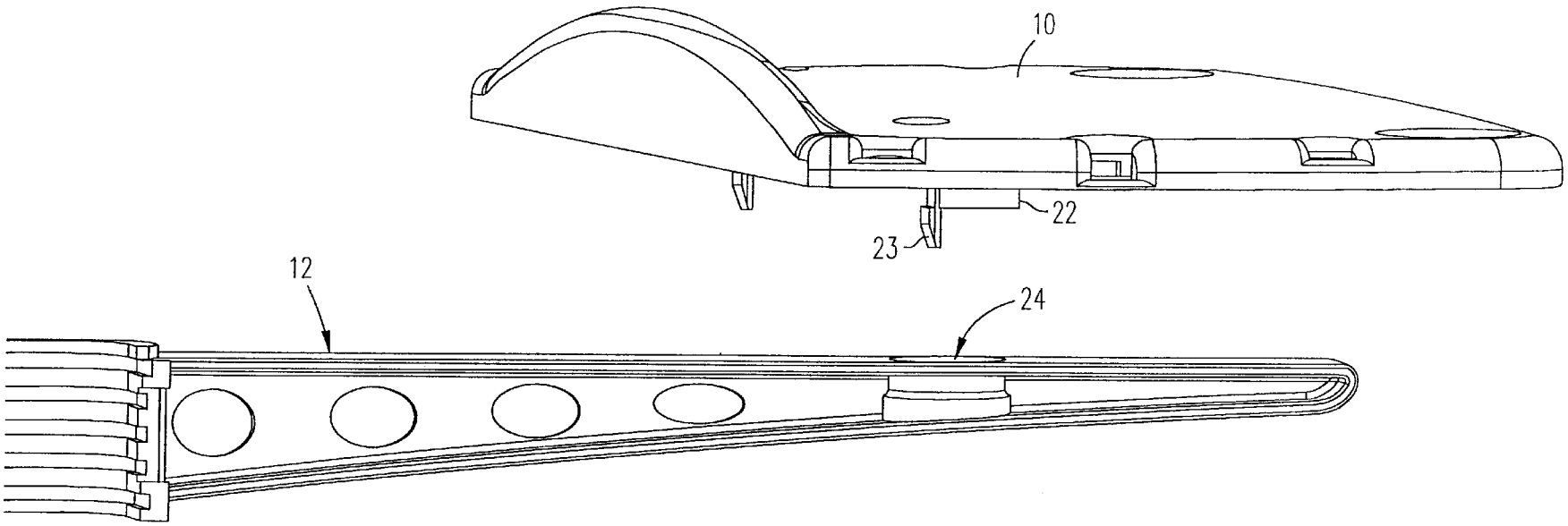
FIG. 5D is a side view of the tray and support arm of the present invention, illustrating flexible snaps to removably secure the tray to the support arms.

FIGS. 5A and 5B illustrate a third alternate embodiment of the present invention, which provides height adjustment to the support arms 12 that can used alone or in conjunction with the height adjustment mechanisms 30 or 42 described above. In this embodiment, the bolt 18 of mounting brackets 14 includes a plurality of circular protrusions 50 that engage in an interlocking fashion with a plurality of circular protrusions 52 formed in bolt hole 20. Bolt hole 20 has a side opening 54 through which bolt 18 can slide out of and into bolt hole 20. When interconnected, the circular protrusions 50/52 prevent any vertical movement while allowing the support arms 12 to horizontally pivot relative to the mounting bracket 14. The user can remove and reinsert bolt 18 into bolt hole 20 at different vertical heights, which allows the user several inches of height adjustment for support arms 12. A locking piece 56 with matching circular protrusions 52 removably locks over the side opening 54 to prevent the bolt 18 from inadvertently sliding out of bolt hole 20 during use. As illustrated in FIG. 5D, flexible latch members 23 can be added to tray 10 adjacent bolts 22 that snap into bolt holes to removably hold tray 10 onto support arms 12.

Figure 6A:
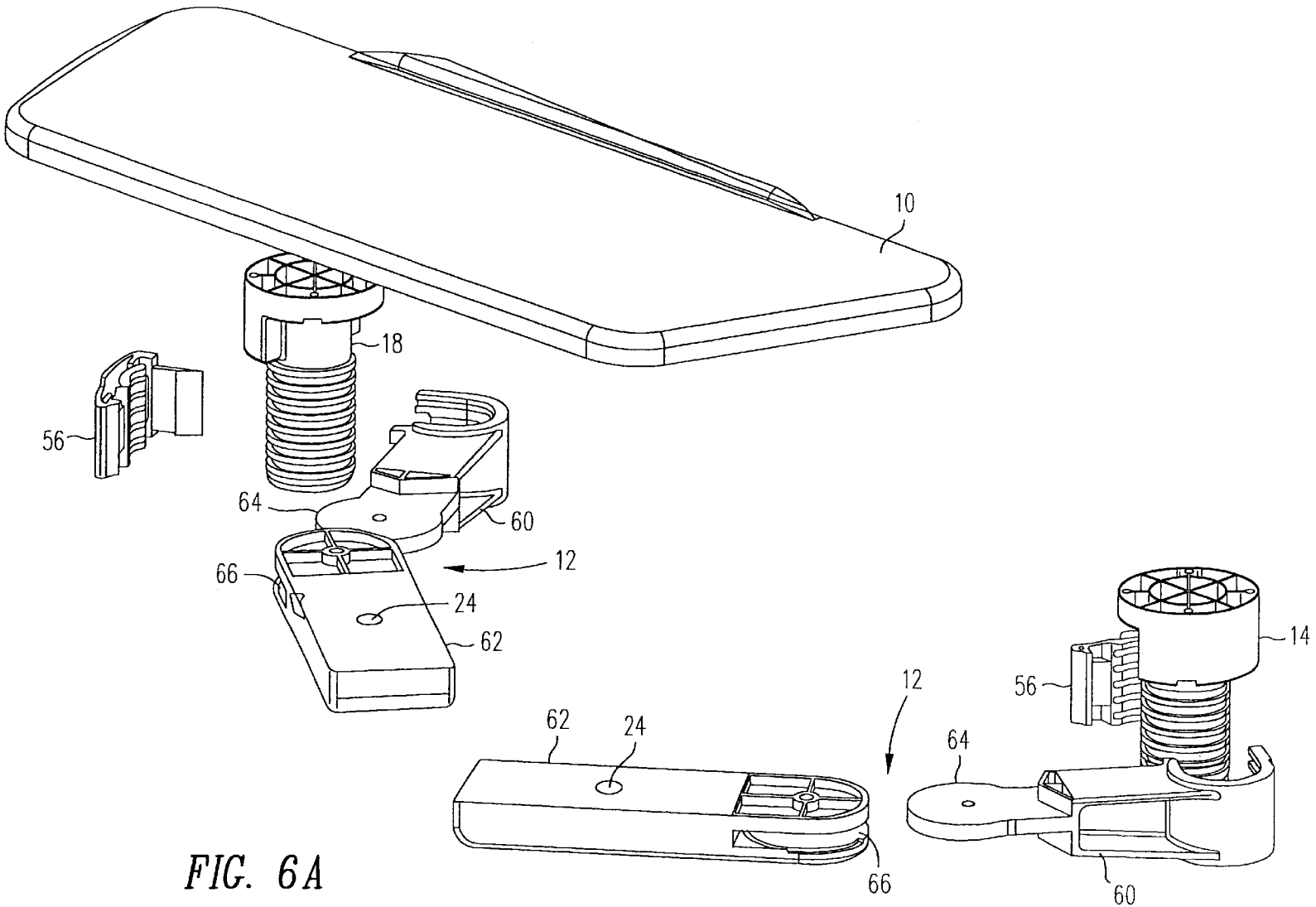
FIG. 6A is an exploded view of a fourth alternate embodiment of the present invention.
Figure 6B:
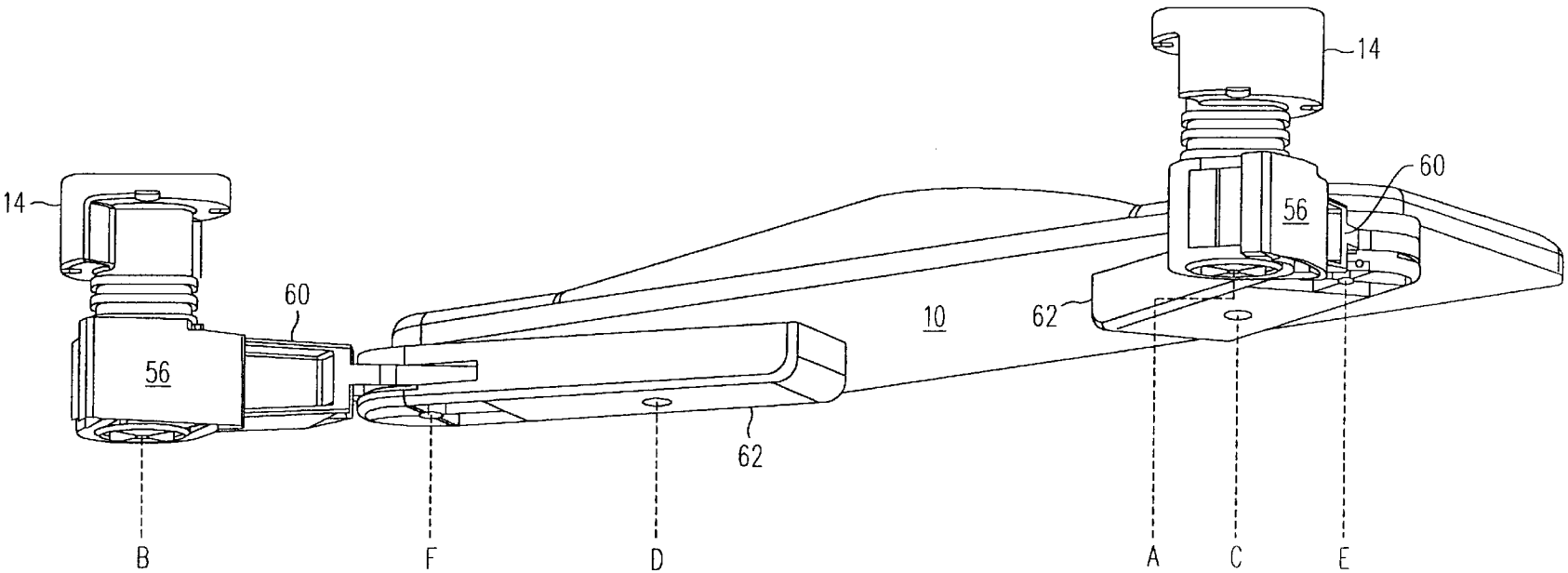
FIG. 6B is a side view of the fourth alternate embodiment of the present invention.

FIGS. 6A and 6B illustrate a fourth alternate embodiment of the present invention, which allows for more versatile horizontal movement of the tray 10. In this embodiment, each support arm 12 comprises first and second segments 60 and 62 respectively that are pivotally connected together. The first and second segments 60/62 pivot horizontally relative to each other, but are rigid in the vertical direction. Preferably, one of the first/second segments 60/62 includes a circularly shaped tongue 64 that inserts into a slot 66 formed in the other segment 60/62, with a bolt extending through the center of both about which the segments pivot to define pivot axes E and F. The other end of the first segment 60 is pivotally attached to the mounting bracket 14 (as described above), and the other end of the second segment 62 is pivotally attached to the tray 10 (as described above).

Figure 7A:
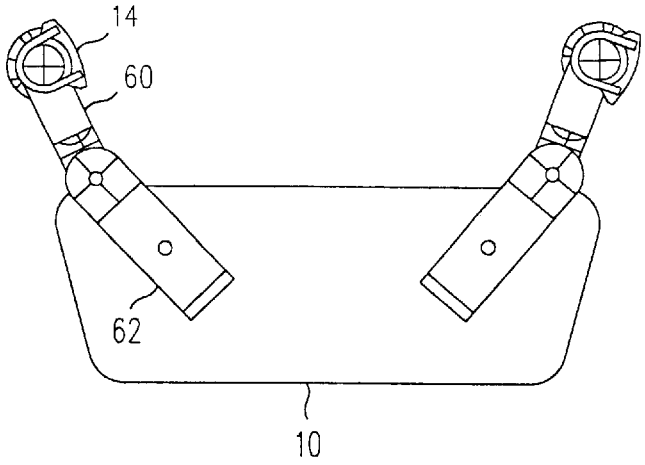
FIGS. 7A to 7B are bottom views of the fourth alternate embodiment of the present invention, illustrating the forward and rearward movement of the tray.
Figure 7B:
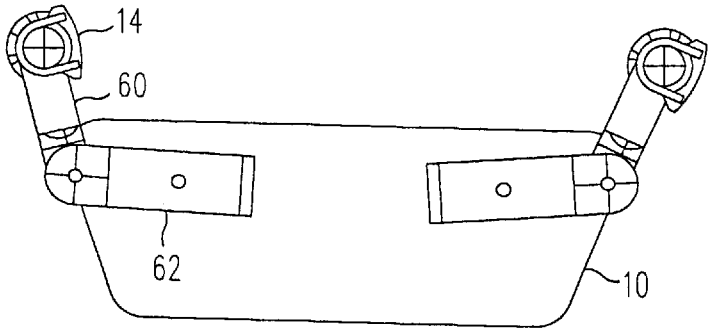
Figure 7C:
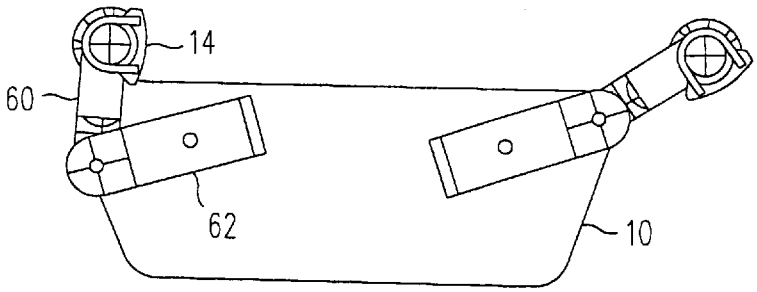
FIGS. 7C to 7D are bottom views of the fourth alternate embodiment of the present invention, illustrating the side to side movement of the tray.
Figure 7D:
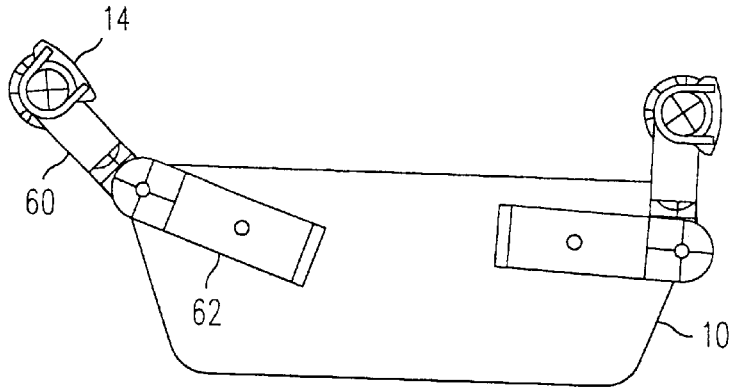
Figure 7E:
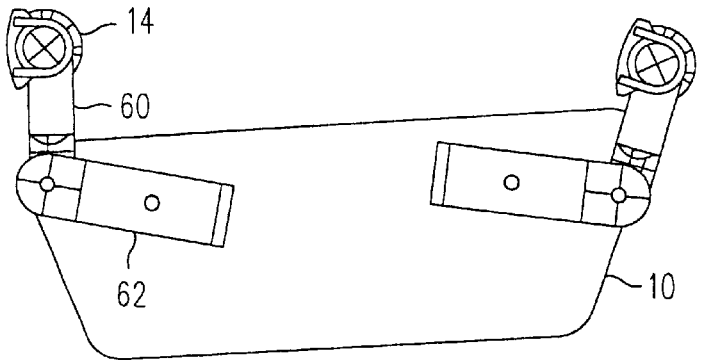
FIGS. 7E to 7F are bottom views of the fourth alternate embodiment of the present invention, illustrating the angular movement of the tray around the user.
Figure 7F:
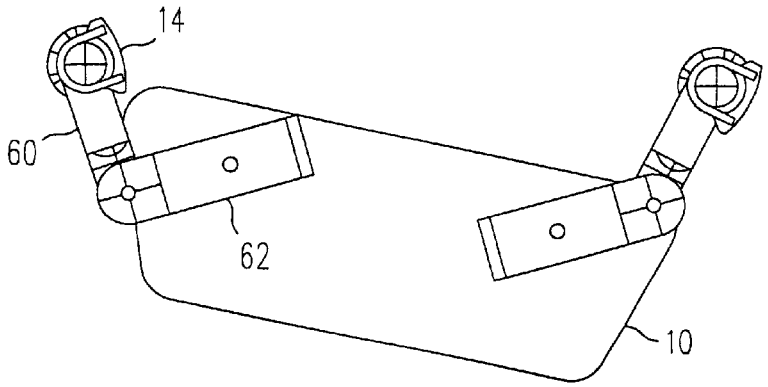
Figure 8A:
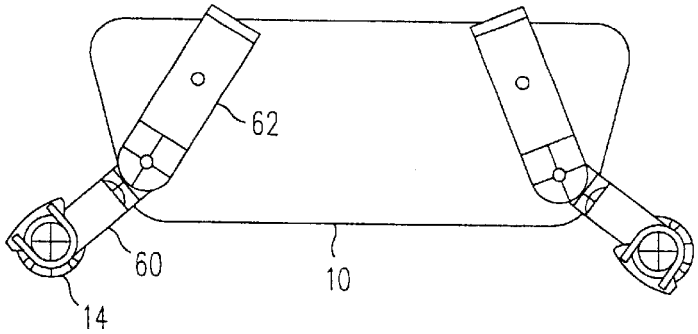
FIGS. 8A to 8D are bottom views of the fourth alternate embodiment of the present invention, illustrating the 'S' shaped movement of the tray from its protracted position to its retracted position.
Figure 8B:
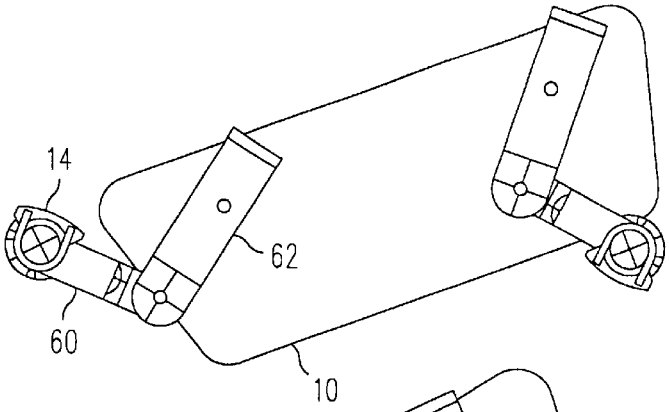
Figure 8C:
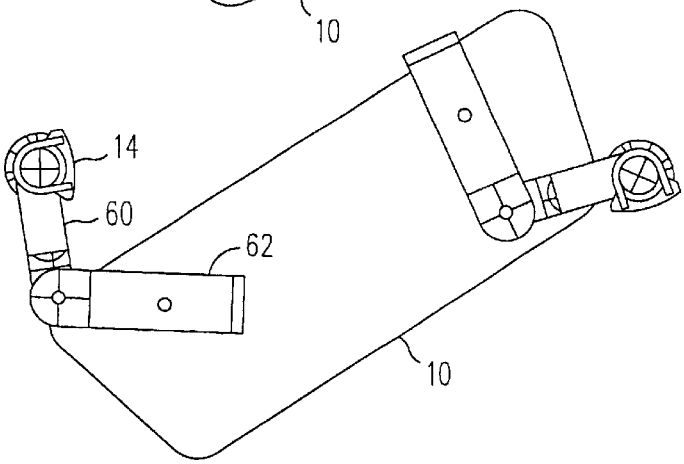
Figure 8D:
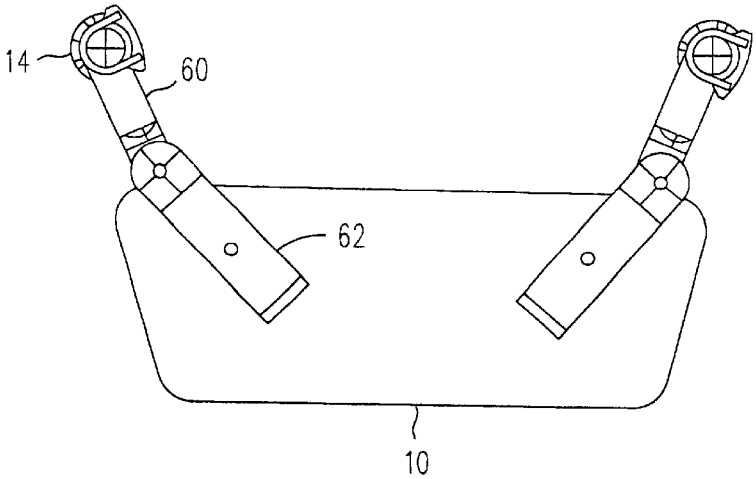
Figure 9A:
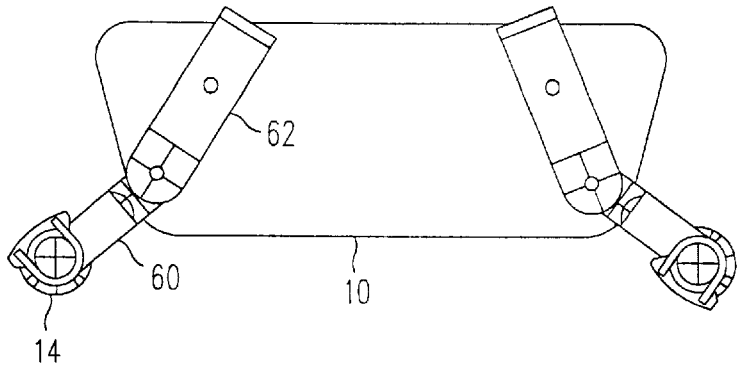
FIGS. 9A to 9D are bottom views of the fourth alternate embodiment of the present invention, illustrating the straight movement of the tray from its protracted position to its retracted position.
Figure 9B:
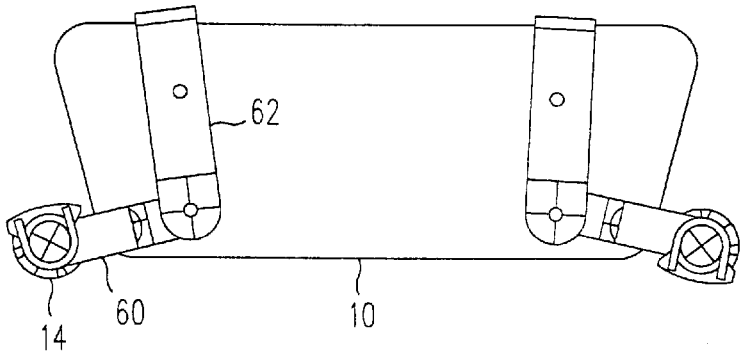
Figure 9C:
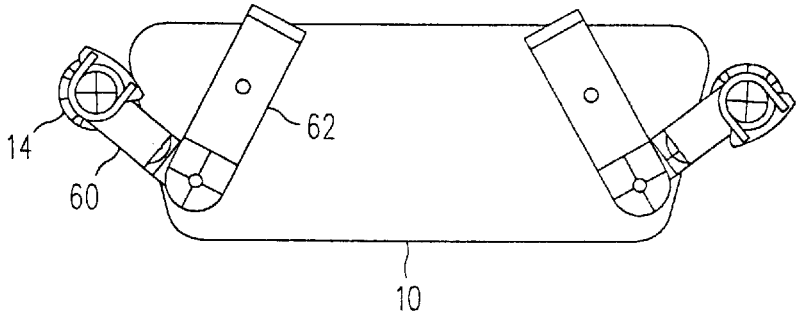
Figure 9D:
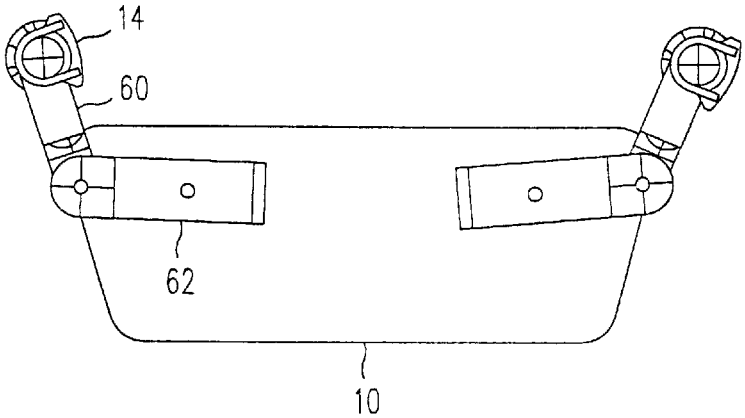

Adding pivot axes E and F at midpoints of support arms 12 allows the user to independently move the tray 10 to an infinite number of locations. For example, the tray can be moved forward and back (as illustrated in FIGS. 7A and 7B), side to side (FIGS. 7C and 7D), and/or at different angles around the user (FIGS. 7E and 7F). If the distance between the mounting brackets 14 is smaller than the length of tray 10, then the 'S' motion depicted in FIGS. 8A to 8D can be used to deploy and stow the tray 10 relative to the desktop. If the distance between the mounting brackets 14 is larger than the length of tray 10, then tray 10 can be deployed and stowed with a simple straight-back motion, as illustrated in FIGS. 9A to 9D.

It may be beneficial to limit the rotation of arm segments 60/62 relative to each other. For example, limiting relative rotation so that the segments 60/62 never form a straight line would ensure that the tray would never appear to lock or be stiff to move when the user tries to move the tray forwards and backwards. Therefore, in this embodiment, tongue 64 and slot 66 preferably formed to prevent the arm segments 60/62 from rotating into a straight configuration relative to each other.

Figure 10:
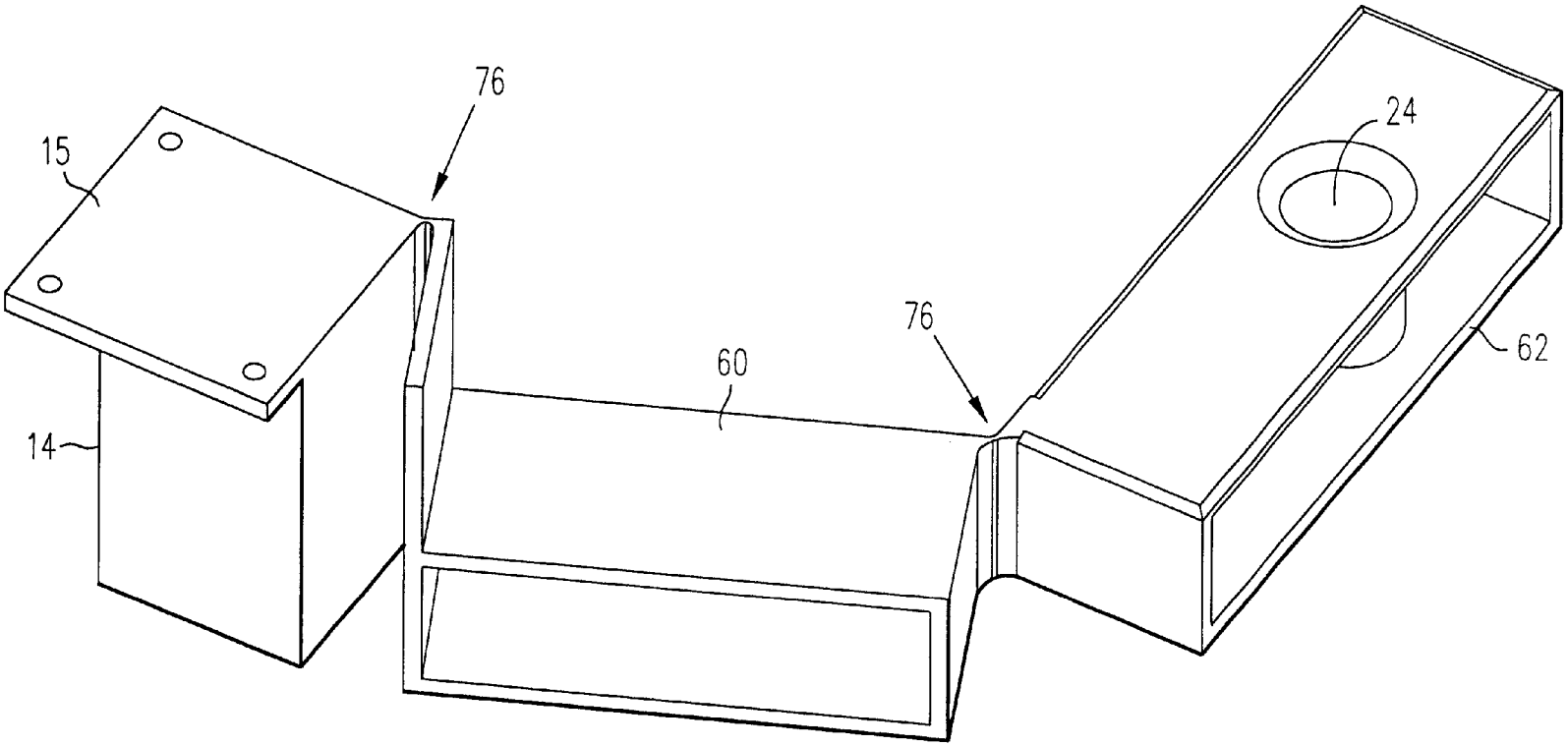
FIG. 10 is a perspective view of a fifth alternate embodiment of the present invention, which utilizes living hinges.

FIG. 10 illustrates a fifth alternate embodiment of the present invention, where the mounting bracket 14, first support arm segment 60 and the second support arm segment 62 of FIGS. 6A and 6B are pivotally connected together by living hinges 76. Each living hinge 76 is formed by a thin material that joins adjacent components, where the thin material flexes in the horizontal direction but not the vertical direction. The living hinges are made of a material with a given thickness so that they can withstand thousands of flexing cycles, such as polypropylene or polyolefins. Preferably, the mounting bracket 14 and the first and second support arm segments 60/62 are all integrally formed together from the same material, with a reduced thickness where these elements meet to form the living hinges 76.

Figure 11:
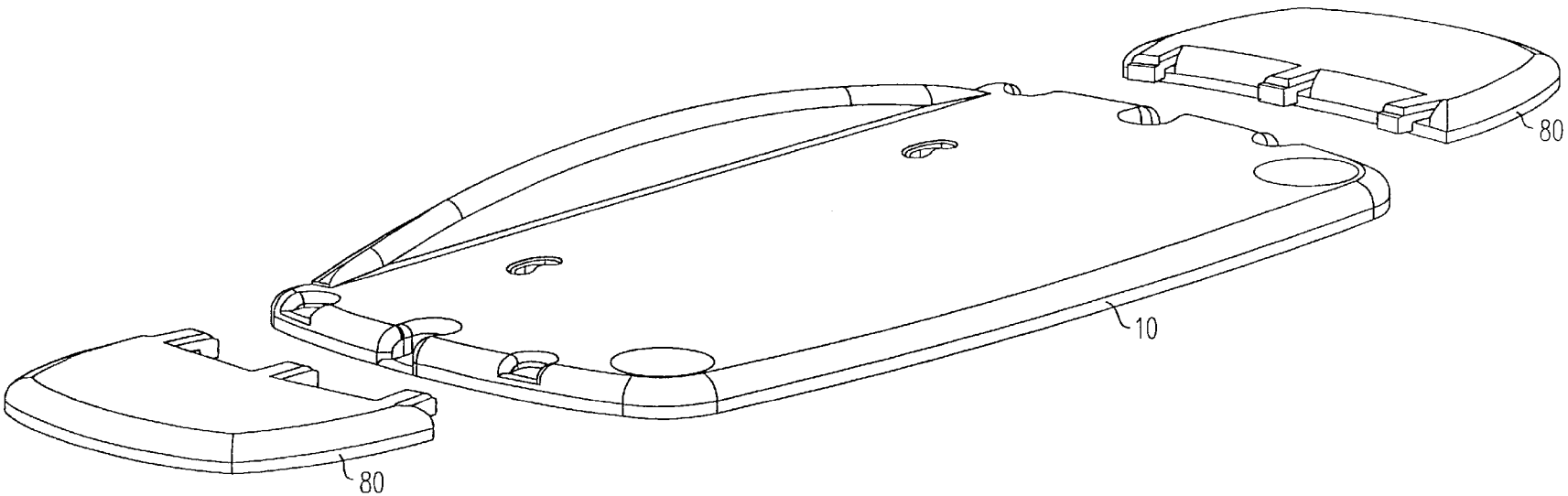
FIG. 11 is a perspective view of the tray of the present invention, with mouse trays attached thereto.

For the above embodiments, it may be beneficial to include detentes or springs to some or all pivoted connections to selectively lock the tray 10 into place at various desired working or stowed positions. Additionally, mouse trays can be added to tray 10, which pivot out from, or removably attached to, tray 10 as illustrated in FIG. 11.

Figure 12:
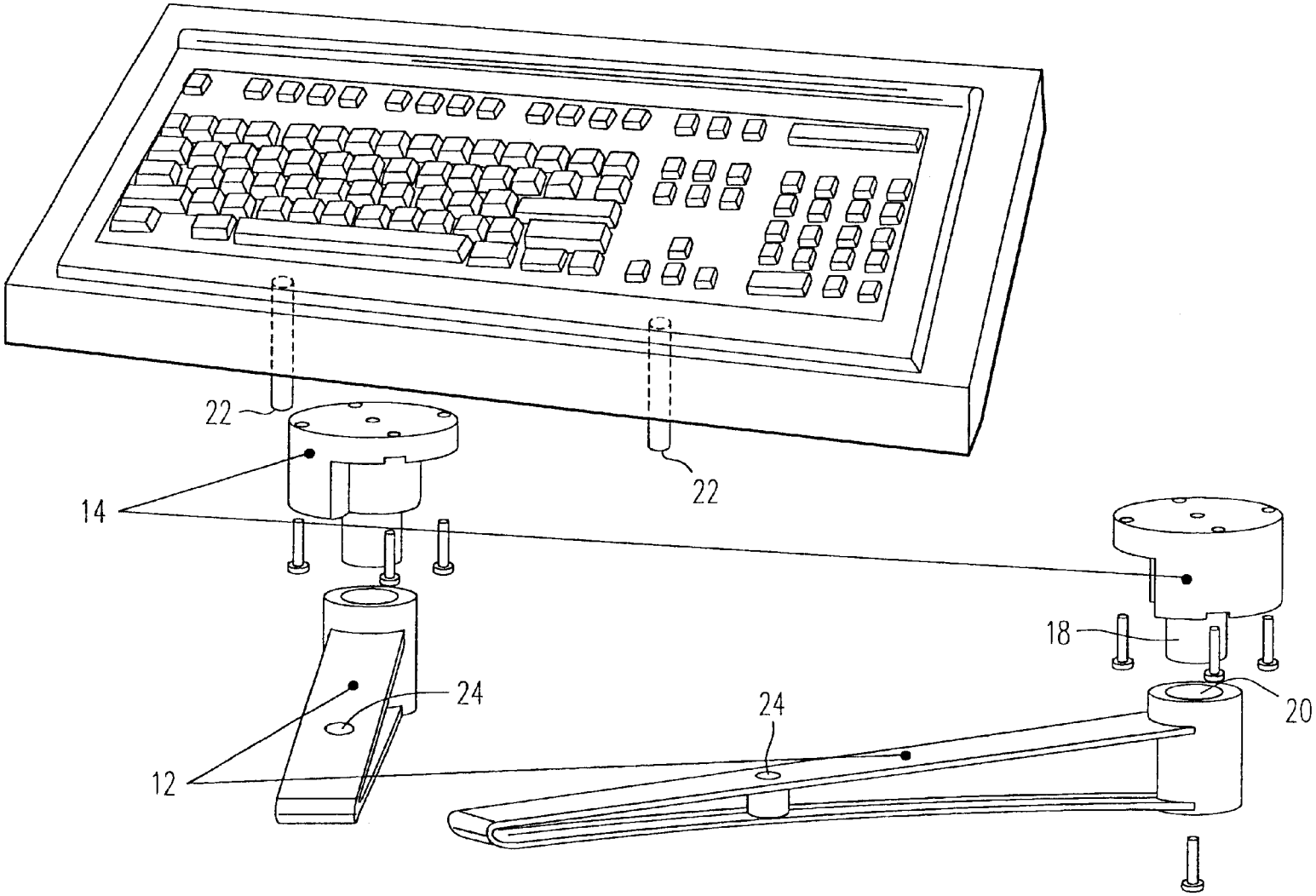
FIG. 12 is an exploded side view of a sixth alternate embodiment of the present invention.

It should be noted that the present invention includes all the above embodiments, but where the tray 10 is eliminated and the support arms 12 are directly pivotally attached to the bottom of the keyboard itself, as illustrated in FIG. 12. With this embodiment, the keyboard support assembly is lightweight and inexpensive because it includes only two support arms and two mounting brackets. Such a keyboard support assembly could be shipped with every new keyboard in a cost effective manner while not taking up valuable space. The pivotal attachment to the keyboard could be a removable connection, so the keyboard could be used separately without connection to the desk according to the present invention.

It is to be understood that the present invention is not limited to the embodiments described above and illustrated herein, but encompasses any and all variations falling within the scope of the appended claims. For example, the bolts and bolt holes can be reversed and still provide a simple pivotal attachment between the various elements. The present invention mounts to the underside of any structure, not just a desk or workstation, for providing a support platform for any application, not just a computer keyboard.

What is claimed is:

1. A support assembly for selectively stowing a support surface under a desktop, the support assembly comprising:

first and second mounting brackets each having a mounting surface for attachment to a bottom surface of a desktop;

first and second support arms pivotally attached to the first and second mounting brackets; respectively to define first and second pivot axes, the first and second support arms rotate in a single plane about the first and second pivot axes respectively; and a platform having a top support surface and a bottom surface, the first and second supports arms are pivotally attached to the bottom surface of the platform to define third and fourth pivot axes respectively, the support arms are rotatable relative to the platform in the single plane about the third and fourth pivot axes respectively;

wherein the distance between the first and second pivot axes is greater than the distance between the third and fourth pivot axes so that the platform is translatable between the mounting brackets, in a plane that is located between the single plane and the mounting surfaces of the mounting brackets, from a deployed position in front of the desktop to a retracted position underneath the desktop.

2. The support assembly of claim 1, wherein:

the distance between the first and second pivot axes is $L_{AB}$;

the distance between the third and fourth pivot axes is $L_{CD}$;

the distance between the first and third pivot axes along the first support arm is $L_{arm}$;

the distance between the second and fourth pivot axes along the second support arm is $L_{arm}$; and the pivot axes are located so that $L_{CD}$ is less than $L_{AB}$, and $L_{CD}$ is greater than $(2 \cdot L_{arm})-L_{AB}$,so that the platform translates from the retracted position to the deployed position in an "S" shaped trajectory.

3. The support assembly of claim 2, wherein the platform has a length L that is greater than the distance $L_{AB}$.

4. The support assembly of claim 2, wherein:

the platform extends from the third and fourth pivot axes by a maximum distance $R_{tray}$;

the mounting brackets have a clearance radius of $R_{mount}$; and the distance $R_{tray}$ is smaller than the distance $L_{arm}$, and $R_{tray}=L_{AB}-L_{arm}-R_{mount}$.

5. The support assembly of claim 2, wherein $L_{arm}$ is substantially equal to $0.5 \cdot L_{AB}$.

6. The support assembly of claim 1, wherein the pivotal attachments between the platform and first and second support arms include:

a first support member having a first end pivotally attached to the first support arm for rotation in planes both parallel and perpendicular to the single plane, and a second end pivotally attached to the platform; and a second support member having a first end pivotally attached to the second support arm for rotation in planes both parallel and perpendicular to the single plane, and a second end for engaging with the bottom surface of the platform;

wherein the first support member has a midsection that is pivotally attached to a midsection of the second support member so that the first and second support members rotate about each other in a scissor motion in a plane substantially perpendicular to the single plane as the platform is lifted away from the first and second support arms.

7. The support assembly of claim 6, further comprising a fixing device for selectively preventing the first and second support members from rotating about each other.

8. The support assembly of claim 7, wherein the fixing device includes:

a plurality of teeth on the bottom surface of the platform for engaging with the second end of the second support member;

a flexure attached to the platform;

a retaining member attached to the flexure for engaging with the second end of the second support member to maintain engagement between the teeth and the second end of the second support member;

wherein when the flexure is flexed, the retaining member and the second end of the second support member are lifted away and disengaged from the teeth.

9. The support assembly of claim 1, wherein the pivotal attachments between the platform and first and second support arms include:

a first support member having a first end pivotally attached to the first support arm for rotation in planes both parallel and perpendicular to the single plane, and a second end pivotally attached to the platform for rotation in a plane substantially perpendicular to the single plane; and a second support member having a first end pivotally attached to the second support arm for rotation in planes both parallel and perpendicular to the single plane, and a second end pivotally attached to the platform for rotation in a plane substantially perpendicular to the single plane.

10. The support assembly of claim 9, further comprising:

a plurality of tilt feet that are rotatably attached to one of the platform and the support arms to engage with the other of the platform and the support arms for supporting the platform at a tilted position.

11. The support assembly of claim 1, wherein:

the pivotal attachment between the first support arm and the first mounting bracket includes:

a first bolt extending from the first mounting bracket having a plurality of circular protrusions, the first support arm forming a first bolt hole having a plurality of circular protrusions that engage with the circular protrusions of the first bolt, wherein the first bolt hole has an open side through which the first bolt is insertable at various heights relative to the first bolt hole, and a first locking piece having circular protrusions that engage with the circular protrusions of the first bolt, and being removably attached to the first support arm for covering the open side to secure the first bolt in the first bolt hole; and the pivotal attachment between the second support arm and the second mounting bracket includes:

a second bolt extending from the second mounting bracket having a plurality of circular protrusions, the second support arm forming a second bolt hole having a plurality of circular protrusions that engage with the circular protrusions of the second bolt, wherein the second bolt hole has an open side through which the second bolt is insertable at various heights relative to the second bolt hole, and a second locking piece having circular protrusions that engage with the circular protrusions of the second bolt, and being removably attached to the second support arm for covering the open side to secure the second bolt in the second bolt hole.

12. The support assembly of claim 1, wherein the pivotal attachments between the platform and first and second support arms each include a latch member that removably secures the platform to the respective support arm.

13. The support assembly of claim 1, wherein:

the first support arm comprises:

a first segment pivotally attached to the first mounting bracket about the first pivot axis, and a second segment pivotally attached to the platform about the third pivot axis, wherein the first and second segments are pivotally attached together to define a fifth pivot axis, the first segment rotates in the single plane relative to the second segment about the fifth pivot axis; and the second support arm comprises:

a third segment pivotally attached to the second mounting bracket about the second pivot axis, and a fourth segment pivotally attached to the platform about the fourth pivot axis, wherein the third and fourth segments are pivotally attached together to define a sixth pivot axis, the third segment rotates in the single plane relative to the fourth segment about the sixth pivot axis.

14. The support assembly of claim 1, wherein:

the first mounting bracket and the first support arm are joined together by a thin flexible material that flexes about the first pivot axis; and the second mounting bracket and the second support arm are joined together by a thin flexible material that flexes about the second.

15. The support assembly of claim 11, wherein:

the first support arm segment is joined to the second Support arm segment by a thin flexible material that flexes about the fifth pivot axis; and the third support arm segment is joined to the fourth support arm segment by a thin flexible material that flexes about the sixth pivot axis.

16. A computer keyboard support assembly for selective storage under a desktop, the support assembly comprising:

first and second mounting brackets each having a mounting surface for attachment to a bottom surface of a desktop;

first and second support arms pivotally attached to the first and second mounting brackets respectively to define first and second pivot axes, the first and second support arms rotate in a single plane about the first and second pivot axes respectively; and a computer keyboard having a top surface with input keys and a bottom surface, wherein the first and second support arms are pivotally attached to the bottom surface of the keyboard to define third and fourth pivot axes respectively, the support arms are rotatable relative to the keyboard in the single plane about the third and fourth pivot axes respectively;

wherein the distance between the first and second pivot axes is greater than the distance between the third and fourth pivot axes so that the keyboard is translatable between the mounting brackets, in a plane that is located between the single plane and the mounting surfaces of the mounting brackets, from a deployed position in front of the desktop to a retracted position underneath the desktop.

17. The support assembly of claim 16, wherein:

the distance between the first and second pivot axes is $L_{AB}$;

the distance between the third and fourth pivot axes is $L_{CD}$;

the distance between the first and third pivot axes along the first support arm is $L_{arm}$;

the distance between the second and fourth pivot axes along the second support arm is $L_{arm}$; and the pivot axes are located so that $L_{CD}$ is less than $L_{AB}$, and $L_{CD}$ is greater than $(2 \cdot L_{arm})-L_{AB}$, so that the keyboard translates from the retracted position to the deployed position in an "S" shaped trajectory.

18. The support assembly of claim 17, wherein the keyboard has a length L that is greater than the distance $L_{AB}$.

19. The support assembly of claim 17, wherein:

the keyboard extends from the third and fourth pivot axes by a maximum distance $R_{tray}$;

the mounting brackets have a clearance radius of $R_{mount}$; and the distance $R_{tray}$ is smaller than the distance $L_{arm}$, and $R_{tray}=L_{AB}-L_{arm}-R_{mount}$.

20. The support assembly of claim 17, wherein $L_{arm}$ is substantially equal to $0.5 \cdot L_{AB}$.

21. The support assembly of claim 16, wherein the pivotal attachments between the keyboard and first and second support arms include:

a first support member having a first end pivotally attached to the first support arm for rotation in planes both parallel and perpendicular to the single plane, and a second end pivotally attached to the keyboard; and a second support member having a first end pivotally attached to the second support arm for rotation in planes both parallel and perpendicular to the single plane, and a second end for engaging with the bottom surface of the keyboard;

wherein the first support member has a midsection that is pivotally attached to a midsection of the second support member so that the first and second support members rotate about each other in a scissor motion in a plane substantially perpendicular to the single plane as the keyboard is lifted away from the first and second support arms.

22. The support assembly of claim 21, further comprising a fixing device for selectively preventing the first and second support members from rotating about each other.

23. The support assembly of claim 22, wherein the fixing device includes:

a includes plurality of teeth on the bottom surface of the keyboard for engaging with the second end of the second support member;

a flexure attached to the keyboard;

a retaining member attached to the flexure for engaging with the second end of the second support member to maintain engagement between the teeth and the second end of the second support member, wherein when the flexure is flexed, the retaining member and the second end of the second support member are lifted away and disengaged from the teeth.

24. The support assembly of claim 16, wherein the pivotal attachments between the keyboard and first and second support arms include:

a first support member having a first end pivotally attached to the first support arm for rotation in planes both parallel and perpendicular to the single plane, and a second end pivotally attached to the keyboard for rotation in a plane substantially perpendicular to the single plane; and a second support member having a first end pivotally attached to the second support arm for rotation in planes both parallel and perpendicular to the single plane, and a second end pivotally attached to the keyboard for rotation in a plane substantially perpendicular to the single plane.

25. The support assembly of claim 24, further comprising:

a plurality of tilt feet that are rotatably attached to one of the keyboard and the support arms to engage with the other of the keyboard and the support arms for supporting the keyboard at a tilted position.

26. The support assembly of claim 16, wherein:

the pivotal attachment between the first support arm and the first mounting bracket includes:

a first bolt extending from the first mounting bracket having a plurality of circular protrusions, the first support arm forming a first bolt hole having a plurality of circular protrusions that engage with the circular protrusions of the first bolt, wherein the first bolt hole has an open side through which the first bolt is insertable at various heights relative to the first bolt hole, and a first locking piece having circular protrusions that engage with the circular protrusions of the first bolt, and being removably attached to the first support arm for covering the open side to secure the first bolt in the first bolt hole; and the pivotal attachment between the second support arm and the second mounting bracket includes:

a second bolt extending from the second mounting bracket having a plurality of circular protrusions, the second support arm forming a second bolt hole having a plurality of circular protrusions that engage with the circular protrusions of the second bolt, wherein the second bolt hole has an open side through which the second bolt is insertable at various heights relative to the second bolt hole, and a second locking piece having circular protrusions that engage with the circular protrusions of the second bolt, and being removably attached to the second support arm for covering the open side to secure the second bolt in the second bolt hole.

27. The support assembly of claim 16, wherein the pivotal attachments between the keyboard and first and second support arms each include a latch member that removably secures the keyboard to the respective support arm.

28. The support assembly of claim 16, wherein:

the first support arm comprises:

a first segment pivotally attached to the first mounting bracket about the first pivot axis, and a second segment pivotally attached to the keyboard about the third pivot axis, wherein the first and second segments are pivotally attached together to define a fifth pivot axis, the first segment rotates in the single plane relative to the second segment about the fifth pivot axis; and the second support arm comprises:

a third segment pivotally attached to the second mounting bracket about the second pivot axis, and a fourth segment pivotally attached to the keyboard about the fourth pivot axis, wherein the third and fourth segments are pivotally attached together to define a sixth pivot axis, the third segment rotates in the single plane relative to the fourth segment about the sixth pivot axis.

29. The support assembly of claim 16, wherein:

the first mounting bracket and the first support arm are joined together by a thin flexible material that flexes about the first pivot axis; and the second mounting bracket and the second support arm are joined together by a thin flexible material that flexes about the second.

30. The support assembly of claim 28, wherein:

the first support arm segment is joined to the second support arm segment by a thin flexible material that flexes about the fifth pivot axis; and the third support arm segment is joined to the fourth support arm segment by a thin flexible material that flexes about the sixth pivot axis.

* * * * *